US011252524B2

(12) United States Patent
Magariyachi et al.

(10) Patent No.: US 11,252,524 B2
(45) Date of Patent: Feb. 15, 2022

(54) SYNTHESIZING A HEADPHONE SIGNAL USING A ROTATING HEAD-RELATED TRANSFER FUNCTION

(71) Applicant: SONY CORPORATION, Tokyo (JP)

(72) Inventors: Tetsu Magariyachi, Kanagawa (JP); Yuhki Mitsufuji, Tokyo (JP)

(73) Assignee: SONY CORPORATION, Tokyo (JP)

( * ) Notice: Subject to any disclaimer, the term of this patent is extended or adjusted under 35 U.S.C. 154(b) by 31 days.

(21) Appl. No.: 16/626,043

(22) PCT Filed: Jun. 21, 2018

(86) PCT No.: PCT/JP2018/023557
§ 371 (c)(1),
(2) Date: Dec. 23, 2019

(87) PCT Pub. No.: WO2019/009085
PCT Pub. Date: Jan. 10, 2019

(65) Prior Publication Data

US 2021/0144504 A1 May 13, 2021

(30) Foreign Application Priority Data

Jul. 5, 2017 (JP) ..... JP2017-132187

(51) Int. Cl.
*H04S 3/02* (2006.01)
*H04R 5/033* (2006.01)
*H04S 7/00* (2006.01)

(52) U.S. Cl.
CPC ..... *H04S 3/02* (2013.01); *H04R 5/033* (2013.01); *H04S 7/304* (2013.01);
(Continued)

(58) Field of Classification Search
CPC ..... H04S 3/02; H04S 7/304; H04S 2420/01; H04S 2420/11; H04R 5/033; H04R 2400/01
(Continued)

(56) References Cited

U.S. PATENT DOCUMENTS

2013/0064375 A1 3/2013 Atkins et al.
2014/0355766 A1 12/2014 Morrell et al.
(Continued)

FOREIGN PATENT DOCUMENTS

CN 105325015 A 2/2016
EP 3005738 A2 4/2016
(Continued)

OTHER PUBLICATIONS

Daniel, et al., "Further Investigations of High Order Ambisonics and Wavefield Synthesis for Holophonic Sound Imaging", Audio Engineering Society, Convention Paper 5788, 114th Convention, Mar. 22-25, 2003, 18 pages.
(Continued)

*Primary Examiner* — Norman Yu
(74) *Attorney, Agent, or Firm* — Chip Law Group

(57) ABSTRACT

The present technology relates to signal processing device and method that make it possible to reproduce sound more effectively. A signal processing device includes a rotation operation unit that rotates a head-related transfer function in a spherical harmonic domain by an operation on the basis of a rotation matrix corresponding to rotation of a head of a listener, the operation in which an order of the rotation matrix is limited, and a synthesis unit that synthesizes the head-related transfer function after rotation obtained by the operation and a sound signal of the spherical harmonic domain to generate a headphone drive signal. The present technology is applicable to an audio processor.

10 Claims, 21 Drawing Sheets

(52) U.S. Cl.
CPC ..... *H04R 2400/01* (2013.01); *H04S 2420/01* (2013.01); *H04S 2420/11* (2013.01)

(58) Field of Classification Search
USPC ..... 381/10, 17–23, 306–307, 309, 310, 58, 381/74
See application file for complete search history.

(56) References Cited

U.S. PATENT DOCUMENTS

| | | | | |
|---|---|---|---|---|
| 2016/0241980 | A1* | 8/2016 | Najaf-Zadeh | G06F 3/038 |
| 2017/0295446 | A1* | 10/2017 | Thagadur Shivappa | H04S 3/008 |

FOREIGN PATENT DOCUMENTS

| | | | |
|---|---|---|---|
| JP | 2016-523467 | A | 8/2016 |
| KR | 10-2016-0015284 | A | 2/2016 |
| WO | 2014/194088 | A2 | 12/2014 |

OTHER PUBLICATIONS

Daniel, et al., "Further Investigations of High Order Ambisonics and Wavefield Synthesis for Holophonic Sound Imaging", Convention Paper 5788, Audio Engineering Society 114th Convention, Amsterdam, The Netherlands, Mar. 22-25, 2003, 18 pages.
International Search Report and Written Opinion of PCT Application No. PCT/JP2018/023557, dated Sep. 11, 2018, 06 pages of ISRWO.

* cited by examiner

SYNTHESIZING A HEADPHONE SIGNAL USING A ROTATING HEAD-RELATED TRANSFER FUNCTION

CROSS REFERENCE TO RELATED APPLICATIONS

This application is a U.S. National Phase of International Patent Application No. PCT/JP2018/023557 filed on Jun. 21, 2018, which claims priority benefit of Japanese Patent Application No. JP 2017-132187 filed in the Japan Patent Office on Jul. 5, 2017. Each of the above-referenced applications is hereby incorporated herein by reference in its entirety.

TECHNICAL FIELD

The present technology relates to signal processing device and method, and a program, and specifically to signal processing device and method, and a program that make it possible to reproduce sound more efficiently.

BACKGROUND ART

In recent years, development and spread of systems that record, transmit, and reproduce spatial information from an entire environment have been progressing in the field of sound. For example, in Super Hi-Vision, broadcasting is being planned using three-dimensional 22.2 multichannel sound.

Further, in the field of virtual reality, systems that also reproduce signals surrounding the entire environment for sound in addition to an image surrounding the entire environment are becoming popular.

Among them, there is a technique of representing three-dimensional audio information, which is flexibly adaptable to any recording/reproducing system. The technique is called ambisonics, and has been attracting attention. In particular, second or higher order ambisonics is called higher order ambisonics (HOA) (see NPTL 1, for example).

In three-dimensional multichannel sound, sound information spread along a spatial axis in addition to a time axis, and in ambisonics, information is held by performing frequency transformation, that is, spherical harmonic function transformation relative to an angular direction of three-dimensional polar coordinates. It is possible to consider that the spherical harmonic function transformation corresponds to time-frequency transformation of an audio signal with respect to a time axis.

Advantages of this method include ability to encode and decode information from any microphone array to any speaker array without limiting the number of microphones or the number of speakers.

In contrast, impediments to spread of ambisonics include need for a speaker array including a large number of speakers in a reproduction environment, and a narrow range (sweet spot) where it is possible to reproduce sound space.

For example, a speaker array including more speakers is necessary to increase spatial resolution of sound, but it is impractical to increase such a system at home or the like. In addition, in a space such as a movie theater, a region where it is possible to reproduce sound space is narrow, and it is difficult to give desired effects to an entire audience.

CITATION LIST

Non-Patent Literature

NPTL 1: Jerome Daniel, Rozenn Nicol, Sebastien Moreau, "Further Investigations of High Order Ambisonics and Wavefield Synthesis for Holophonic Sound Imaging," AES 114th Convention, Amsterdam, Netherlands, 2003.

SUMMARY OF THE INVENTION

Problems to be Solved by the Invention

It is therefore conceivable to combine ambisonics and binaural reproduction technology. The binaural reproduction technology is generally called virtual auditory display (VAD), and is implemented using a head-related transfer function (HRTF).

Herein, the head-related transfer function expresses information regarding how sound is transmitted from every direction surrounding a human head to binaural eardrums as a function of frequency and arrival direction.

In a case where a synthesis obtained by synthesizing a target sound and the head-related transfer function from a certain direction is presented with headphones, a listener perceives the sound as if the sound comes from the direction of the head-related transfer function used, not from the headphones. The VAD is a system that utilizes such a principle.

In a case where a plurality of virtual speakers are reproduced by using the VAD, it is possible to achieve, by presentation with the headphones, the same effects as those of ambisonics in a speaker array including a plurality of speakers, which is difficult in reality.

However, such a system is able to reproduce sound sufficiently efficiently. For example, in a case where ambisonics and binaural reproduction technology are combined, not only an amount of operations such as a convolution operation of the head-related transfer function increases, but a usage amount of a memory used for the operations and the like also increases.

The present technology has been made in light of such a situation, and makes it possible to reproduce sound more efficiently.

Means for Solving the Problems

A signal processing device according to one aspect of the present technology includes: a rotation operation unit that rotates a head-related transfer function in a spherical harmonic domain by an operation on the basis of a rotation matrix corresponding to rotation of a head of a listener, the operation in which an order of the rotation matrix is limited; and a synthesis unit that synthesizes the head-related transfer function after rotation obtained by the operation and a sound signal of the spherical harmonic domain to generate a headphone drive signal.

A signal processing method or a program according to one aspect of the present technology includes steps of: rotating a head-related transfer function in a spherical harmonic domain by an operation on the basis of a rotation matrix corresponding to rotation of a head of a listener, the operation in which an order of the rotation matrix is limited; and synthesizing the head-related transfer function after rotation obtained by the operation and a sound signal of the spherical harmonic domain to generate a headphone drive signal.

In one aspect of the technology, the head-related transfer function in the spherical harmonic domain is rotated by the operation in which the order of the rotation matrix is limited on the basis of the rotation matrix corresponding to the rotation of the head of the listener, and the head-related transfer function after the rotation obtained by the operation and the sound signal of the spherical harmonic domain are synthesized to generate the headphone drive signal.

Effects of the Invention

According to one aspect of the present technology, it is possible to reproduce sound more efficiently.

It is to be noted that effects of the present technology are not necessarily limited to the effects described here, and may be any of the effects described in the present disclosure.

MODES FOR CARRYING OUT THE INVENTION

Figure 1:
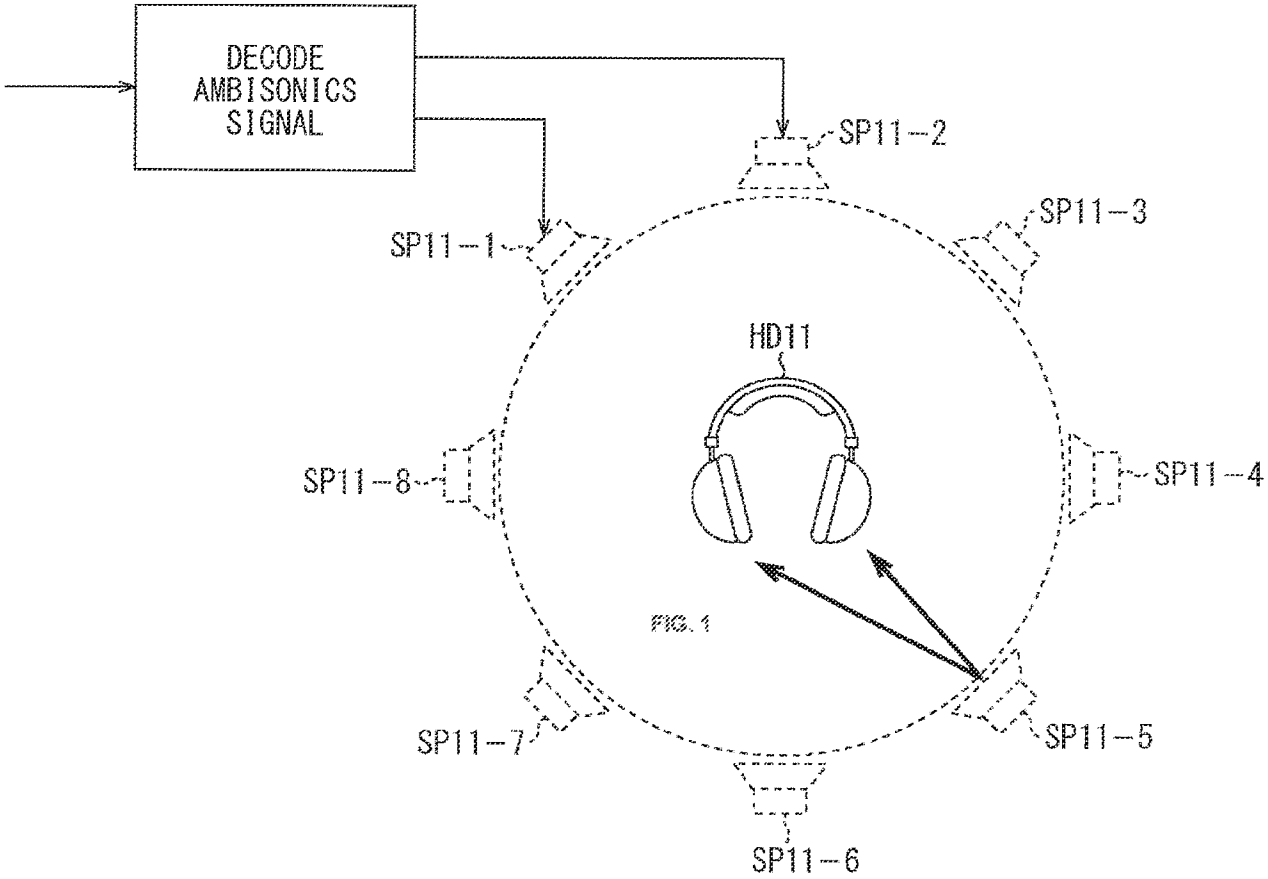
FIG. 1 is a diagram describing simulation of stereophony using a head-related transfer function.

Some embodiments to which the present technology is applied are described below in detail with reference to the drawings.

First Embodiment

<About First Technique>

The present technology achieves a reproduction system that is more efficient in an operation amount and a memory usage amount by determining a head-related transfer function in a spherical harmonic domain corresponding to rotation of a head with use of accumulation of minute rotations and synthesizing, in the spherical harmonic domain, the head-related transfer function and an input signal of sound to be reproduced.

For example, spherical harmonic function transformation on a function $f(\theta, \phi)$ on spherical coordinates is expressed by the following expression (1).

[Math. 1]

$$F_n^m = \int_0^{2\pi}\int_0^{\pi} f(\theta, \phi)\overline{Y_n^m}(\theta, \phi)\sin\theta d\theta d\phi \tag{1}$$

In the expression (1), $\theta$ and $\phi$ respectively represent an elevation angle and a horizontal angle in the spherical coordinates, and $Y_n^m(\theta, \phi)$ represents a spherical harmonic function. In addition, the spherical harmonic function $\overline{Y_n^m}(\theta, \phi)$ with "-" at a top thereof represents a complex conjugate of the spherical harmonic function $Y_n^m(\theta, \phi)$.

Herein, the spherical harmonic function $Y_n^m(\theta, \phi)$ is expressed by the following expression (2).

[Math. 2]

$$Y_n^m(\theta, \phi) = (-1)^m\sqrt{\frac{(2n+1)(n-m)!}{4\pi(n+m)!}}\,P_n^m(\cos\theta)e^{im\phi} \tag{2}$$

In the expression (2), n and m represent a degree and an order of the spherical harmonic function $Y_n^m(\theta, \phi)$, and are $-n \le m \le n$. The order m is also referred to as order or period, and hereinafter, in a case where it is not necessary to particularly distinguish n and m, the degree n and the order m are collectively referred to as degrees.

In addition, in the expression (2), i represents a pure imaginary number, and $P_n^m(x)$ represents an associated Legendre function.

The associated Legendre function $P_n^m(x)$ is expressed by the following expression (3) or (4) in a case where $n \ge 0$ and $0 \le m \le n$. It is to be noted that the expression (3) is in a case where m=0.

[Math. 3]

$$P_n^0(x) = \frac{1}{2^n n!}\frac{d^n}{dx^n}(x^2-1)^n \tag{3}$$

[Math. 4]

$$P_n^m(x) = (1-x^2)^{m/2}\frac{d^n}{dx^n}P_m^0(x) \tag{4}$$

In addition, in a case where $-n \le m \le 0$, the associated Legendre function $P_n^m(x)$ is expressed by the following expression (5).

[Math. 5]

$$P_n^m(x) = (-1)^{-m}\frac{(n+m)!}{(n-m)!}P_n^{-m}(x) \tag{5}$$

Further, inverse transformation from a function $F_n^m$ obtained by the spherical harmonic function transformation into the function f(θ, ϕ) on the spherical coordinates is as expressed in the following expression (6).

[Math. 6]

$$f(\theta, \phi) = \sum_{n=0}^{\infty} \sum_{m=-n}^{n} F_n^m Y_n^m(\theta, \phi) \tag{6}$$

From the above, transformation from an input signal $D'_n{}^m(\omega)$ of sound after correction in a radial direction, which is held in the spherical harmonic domain, into a speaker drive signal $S(x_i, \omega)$ of each of L number of speakers arranged on a spherical surface having a radius R is as expressed in the following expression (7).

[Math. 7]

$$S(x_i, \omega) = \sum_{n=0}^{N} \sum_{m=-n}^{n} D_n^m(\omega) Y_n^m(\beta_i, \alpha_i) \tag{7}$$

It is to be noted that in the expression (7), $x_i$ represents a position of the speaker, and w represents a time frequency of a sound signal. The input signal $D'_n{}^m(\omega)$ is a sound signal corresponding to each degree n and each order m of the spherical harmonic function for a predetermined time frequency ω.

Further, $x_i$=(R sin $\beta_i$ cos $\alpha_i$, R sin $\beta_i$ sin $\alpha_i$, R cos $\beta_i$), and i represents a speaker index that specifies the speaker. Herein, i=1, 2, . . . , L, and $\beta_i$ and $\alpha_i$ respectively represent an elevation angle and a horizontal angle that indicate a position of the i-th speaker.

Such transformation expressed by the expression (7) is spherical harmonic inverse transformation corresponding to the expression (6). In addition, in a case of determining the speaker drive signal S(xi, ω) by the expression (7), it is necessary for the L number of speakers and a degree N of the spherical harmonic function, that is, a maximum value N of the degree n to satisfy a relationship expressed by the following expression (8). The L number of speakers is the number of reproducing speakers.

[Math. 8]

$$L > (N+1)^2 \tag{8}$$

Incidentally, a general technique of simulating stereophony at ears by representation with headphones is, for example, a method using the head-related transfer function as illustrated in FIG. 1.

In an example illustrated in FIG. 1, an inputted ambisonics signal is decoded to generate a speaker drive signal of each of virtual speakers SP11-1 to SP11-8, which are a plurality of virtual speakers. The signal decoded at this time corresponds to, for example, the input signal $D'_n{}^m(\omega)$ described above.

Herein, each of the virtual speakers SP11-1 to virtual speakers SP11-8 is annularly disposed and virtually arranged, and the speaker drive signal of each of the virtual speakers is determined by the calculation of the expression (7) described above. It is to be noted that the virtual speakers are also simply referred to as virtual speakers SP11 hereinafter in a case where it is not necessary to particularly distinguish the virtual speakers SP11-1 to SP11-8.

In a case where the speaker drive signals of the respective virtual speakers SP11 are thus obtained, for each of the virtual speakers SP11, left and right drive signals (binaural signals) of headphones HD11 that actually reproduce sound are generated by a convolution operation using the head-related transfer function. Then, the sum of the respective drive signals of the headphones HD11 obtained for each of the virtual speakers SP11 is a final drive signal.

It is to be noted that such a technique is described in detail in, for example, "ADVANCED SYSTEM OPTIONS FOR BINAURAL RENDERING OF AMBISONIC FORMAT (Gerald Enzner et. al. ICASSP 2013) and the like.

The head-related transfer function H(x, ω) used to generate the left and right drive signals of the headphones HD11 is obtained by normalizing a transfer characteristic $H_1(x, \omega)$ from a sound source position x in a state in which a head of a user, who is a listener, exists in free space to positions of eardrums of the user by a transfer characteristic $H_0(x, \omega)$ from the sound source position x in a state in which the head does not exit to a head center O. That is, the head-related transfer function H(x, ω) for the sound source position x is obtained by the following expression (9).

[Math. 9]

$$H(x, \omega) = \frac{H_1(x, \omega)}{H_0(x, \omega)} \tag{9}$$

Herein, the head-related transfer function H(x, ω) is convolved with an optional audio signal, and a thus-obtained result is presented with headphones or the like, which makes it possible to give, to the listener, an illusion as if sound comes from a direction of the convolved head-related transfer function H(x, ω), that is, a direction of the sound source position x.

In the example illustrated in FIG. 1, the left and right drive signals of the headphones HD11 are generated with use of such a principle.

Specifically, the position of each of the virtual speakers SP11 is set as the position $x_i$, and the speaker drive signals of these virtual speakers SP11 are set as $S(x_i, \omega)$.

In addition, the number of the virtual speakers SP11 is set as L (herein, L=8), and the final left and right drive signals of the headphones HD11 are respectively set as $P_l$ and $P_r$.

In this case, in a case where the speaker drive signals $S(x_i, \omega)$ are simulated by presentation with the headphones HD11, it is possible to determine the left and right drive signals $P_l$ and $P_r$ of the headphones HD11 by calculation of the following expression (10).

[Math. 10]

$$P_l = \sum_{i=1}^{L} S(x_i, \omega) H_l(x_i, \omega) \tag{10}$$

$$P_r = \sum_{i=1}^{L} S(x_i, \omega) H_r(x_i, \omega)$$

It is to be noted that, in the expression (10), $H_l(x_i, \omega)$ and $H_r(x_i, \omega)$ represent normalized head-related transfer functions from the position $x_i$ of the virtual speaker SP11 to left and right eardrum positions of the listener, respectively.

Such an operation makes it possible to finally reproduce the input signal $D'_n{}^m(\omega)$ of the spherical harmonic domain by presentation with the headphones. That is, it is possible to achieve the same effects as those of ambisonics by presentation with the headphones.

It is to be noted that, hereinafter, in a case where it is not necessary to particularly distinguish the drive signal $P_l$ and the drive signal $P_r$ for the time frequency ω, the drive signal $P_l$ and the drive signal $P_r$ are also simply referred to as drive signals P(ω). In addition, in a case where it is not necessary to particularly distinguish the head-related transfer function $H_l(x_i, \omega)$ and the head-related transfer function $H_r(x_i, \omega)$, the head-related transfer function $H_l(x_i, \omega)$ and the head-related transfer function $H_r(x_i, \omega)$ are also simply referred to as head-related transfer functions $H(x_i, \omega)$.

Further, hereinafter, the technique of combining ambisonics and binaural reproduction technology described above is also referred to as first technique.

Figure 2:
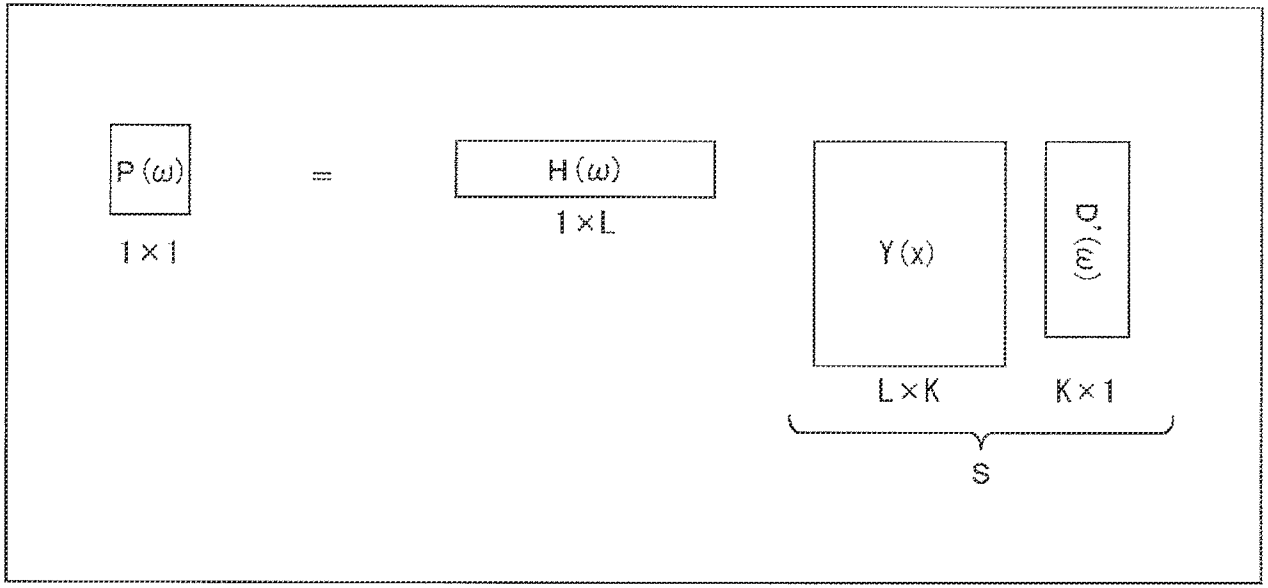
FIG. 2 is a diagram describing calculation of a drive signal in a first technique.

In the first technique, for example, an operation illustrated in FIG. 2 is performed to obtain the drive signal P(ω) of 1×1, that is, one row and one column.

In FIG. 2, H(ω) represents a vector (matrix) of 1×L including the L number of head-related transfer functions $H(x_i, \omega)$. In addition, D'(ω) represents a vector including the input signal $D'_n{}^m(\omega)$, and the vector D'(ω) becomes K×1, where the number of input signals $D'_n{}^m(\omega)$ of bins of the same time frequency ω is K. Further, Y(x) represents a matrix including the spherical harmonic function $Y_n{}^m(\beta_i, \alpha_i)$ of each degree, and the matrix Y(x) becomes a matrix of L×K.

Accordingly, in the first technique, a matrix (vector) S obtained from a matrix operation of the matrix Y(x) of L×K and the vector D'(ω) of K×1 is determined, and a matrix operation of the matrix S and the vector (matrix) H(ω) of 1×L is further performed to obtain one drive signal P(ω).

In addition, in a case where the head of the listener wearing the headphones HD11 rotates in a predetermined direction expressed by a rotation matrix $g_j$ (hereinafter also referred to as direction $g_j$), for example, the drive signal $P_l(g_j, \omega)$ of a left headphone of the headphones HD11 is as expressed in the following expression (11).

[Math. 11]

$$P_l(g_j, \omega) = \sum_{i=1}^{L} S(x_i, \omega) H_l(g_j^{-1} x_i, \omega) \tag{11}$$

It is to be noted that the rotation matrix $g_j$ is a three-dimensional, i.e., 3×3 rotation matrix represented by ϕ, θ, and ψ that are rotational angles of Euler angles. In addition, in the expression (11), the drive signal $P_l(g_j, \omega)$ represents the drive signal $P_l$ described above, and is written as the drive signal $P_l(g_j, \omega)$ herein to clarify the position, that is, the direction $g_j$ and the time frequency ω.

In this case, the rotation direction of the head of the listener, that is, the direction $g_j$ of the head of the listener may be obtained by some sensor, and left and right drive signals of the headphones HD11 may be calculated using the head-related transfer function of a relative direction $g_j^{-1}x_i$ of each of the virtual speakers SP11 viewed from the head of the listener from among a plurality of head-related transfer functions. Thus, even in a case where sound is reproduced by the headphones HD11, it is possible to fix a sound image position viewed from the listener in space similarly to a case where real speakers are used.

<About Second Technique>

In addition, in the first technique, convolution of the head-related transfer function performed in the time frequency domain may be performed in a spherical harmonic domain. Doing so makes it possible to reduce the operation amount and the necessary memory amount as compared with the first technique, and to reproduce sound more efficiently. Such a technique of convoluting the head-related transfer function in the spherical harmonic domain is also referred to as second technique, and the second technique is described below.

For example, in a case where attention is focused on the left headphone, the vector $P_l(\omega)$ including each of the drive signals $P_l(g_l, \omega)$ of the left headphone for all rotation directions of the head of the user (listener), who is a listener, is expressed by the following expression (12).

[Math. 12]

$$\begin{aligned} P_l(\omega) &= H(\omega)S(\omega) \\ &= H(\omega)Y(x)D'(\omega) \end{aligned} \tag{12}$$

It is to be noted that, in the expression (12), S(ω) is a vector including the speaker drive signal $S(x_i, \omega)$, and S(ω)=Y(x)D'(ω). In addition, in the expression (12), Y(x) represents a matrix including each degree and the spherical harmonic function $Y_n{}^m(x_i)$ of the position $x_i$ of each of the virtual speakers expressed by the following expression (13). Herein, i=1, 2, . . . , L, and a maximum value (maximum degree) of the degree n is N.

D'(ω) represents a vector (matrix) including the input signal $D'_n{}^m(\omega)$ of sound corresponding to each degree, which is expressed by the following expression (14). Each input signal $D'_n{}^m(\omega)$ is a sound signal of the spherical harmonic domain.

Further, in the expression (12), H(ω) represents a matrix, as expressed by the following expression (15), including the head-related transfer function $H(g_j^{-1}x_i, \omega)$ of the relative direction $g_j^{-1}x_i$ of each of the virtual speakers viewed from the head of the listener in a case where the direction of the head of the listener is the direction $g_j$. In this example, the head-related transfer function $H(g_j^{-1}x_i, \omega)$ of each of the virtual speakers is prepared for each of the total M number of directions $g_1$ to $g_M$.

[Math. 13]

$$Y(x) = \begin{pmatrix} Y_0^0(x_1) & \dots & Y_N^N(x_1) \\ \vdots & \ddots & \vdots \\ Y_0^0(x_L) & \dots & Y_N^N(x_L) \end{pmatrix} \tag{13}$$

[Math. 14]

$$D'(\omega) = \begin{pmatrix} D_0'^0(\omega) \\ \vdots \\ D_N'^N(\omega) \end{pmatrix} \tag{14}$$

[Math. 15]

$$H(\omega) = \begin{pmatrix} H(g_1^{-1}x_1, \omega) & \dots & H(g_1^{-1}x_L, \omega) \\ \vdots & \ddots & \vdots \\ H(g_M^{-1}x_1, \omega) & \dots & H(g_M^{-1}x_L, \omega) \end{pmatrix} \tag{15}$$

In calculating the drive signal $P_l(g_j, \omega)$ of the left headphone in a case where the head of the listener is directed in the direction $g_j$, it is sufficient if a row corresponding to the direction $g_j$, which is the direction of the head of the listener, that is, a row including the head-related transfer function $H(g_j^{-1}x_i, \omega)$ for the direction $g_j$ is selected from the matrix $H(\omega)$ of the head-related transfer functions to perform calculation of the expression (12).

Figure 3:
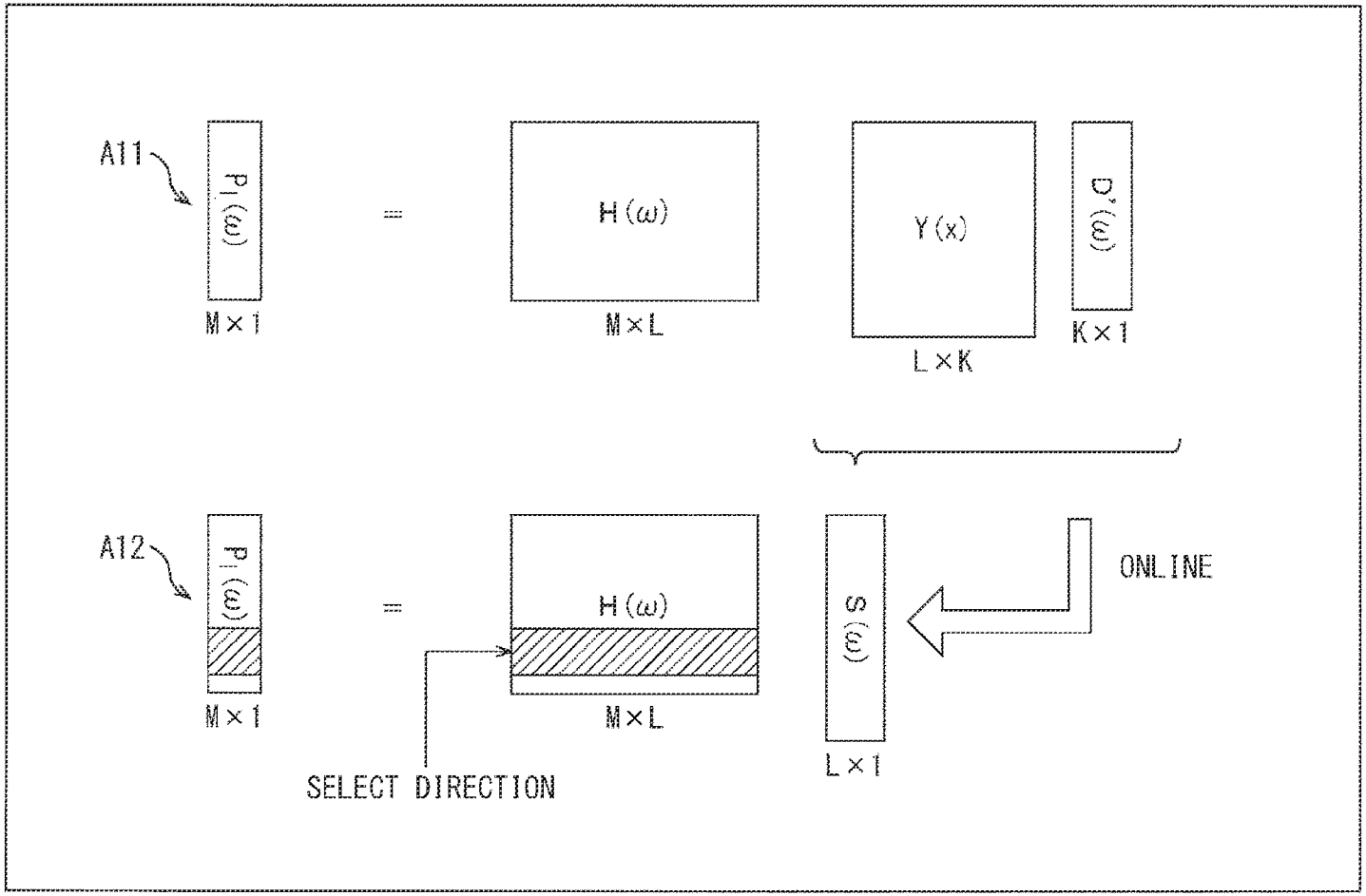
FIG. 3 is a diagram describing calculation of a drive signal in a case where head tracking is performed.

In this case, only a necessary row is calculated as illustrated in FIG. 3, for example.

In this example, the head-related transfer function is prepared for each of the M number of directions; therefore, matrix calculation expressed by the expression (12) is as indicated by an arrow A11.

That is, in a case where the number of input signals $D'_n{}^m(\omega)$ of the time frequency $\omega$ is K, the vector $D'(\omega)$ is K×1, that is, a matrix of K rows and one column. In addition, the matrix Y(x) of the spherical harmonic function is L×K, and the matrix $H(\omega)$ is M×L. Accordingly, in the calculation of the expression (12), the vector $P_l(\omega)$ is M×1.

Herein, a matrix operation (product-sum operation) of the matrix Y(x) and the vector $D'(\omega)$ is first performed in an online operation to determine the vector $S(\omega)$, which makes it possible to select a row corresponding to the direction $g_j$ of the head of the listener in the matrix $H(\omega)$ as indicated by the arrow A12 and reduce the operation amount at the time of calculation of the drive signal $P_l(g_j, \omega)$. In FIG. 3, a hatched portion in the matrix $H(\omega)$ represents the row corresponding to the direction $g_j$, and an operation of this row and the vector $S(\omega)$ is performed to calculate the desired drive signal $P_l(g_j, \omega)$ of the left headphone.

Herein, the matrix $H'(\omega)$ is defined as expressed by the following expression (16), which makes it possible to express, by the following expression (17), the vector $P_l(\omega)$ expressed by the expression (12).

[Math. 16]

$$H'(\omega)=H(\omega)Y(x) \tag{16}$$

[Math. 17]

$$P_l(\omega)=H'(\omega)D'(\omega) \tag{17}$$

In the expression (16), the head-related transfer function, more specifically, the matrix $H(\omega)$ including the head-related transfer function in the time-frequency domain, is transformed by the spherical harmonic function transformation using the spherical harmonic function into the matrix $H'(\omega)$ including the head-related transfer function in the spherical harmonic domain.

Accordingly, in calculation of the expression (17), convolution of the speaker drive signal and the head-related transfer function is performed in the spherical harmonic domain. In other words, in the spherical harmonic domain, the product-sum operation of the head-related transfer function and the input signal is performed. It is to be noted that it is possible to calculate and hold the matrix $H'(\omega)$ in advance.

In this case, in calculating the drive signal $P_l(g_j, \omega)$ of the left headphone in a case where the head of the listener is directed in the direction $g_j$, it is sufficient if only the row corresponding to the direction $g_j$ of the head of the listener is selected from the matrix $H'(\omega)$ held in advance to calculate the expression (17).

In such a case, calculation of the expression (17) is calculation expressed by the following expression (18). This makes it possible to greatly reduce the operation amount and the necessary memory amount.

[Math. 18]

$$P_l(g_j, \omega) = \sum_{n=0}^{N} \sum_{m=-n}^{n} H_n'^m(g_j, \omega) D_n'^m(\omega) \tag{18}$$

In the expression (18), $H'_n{}^m(g_j, \omega)$ is one element of the matrix $H'(\omega)$, that is, a head-related transfer function in the spherical harmonic domain, which is a component (element) corresponding to the direction $g_j$ of the head in the matrix $H'(\omega)$. In the head-related transfer function $H'_n{}^m(g_j, \omega)$, n and m represent the degree n and the order m of the spherical harmonic function.

Figure 4:
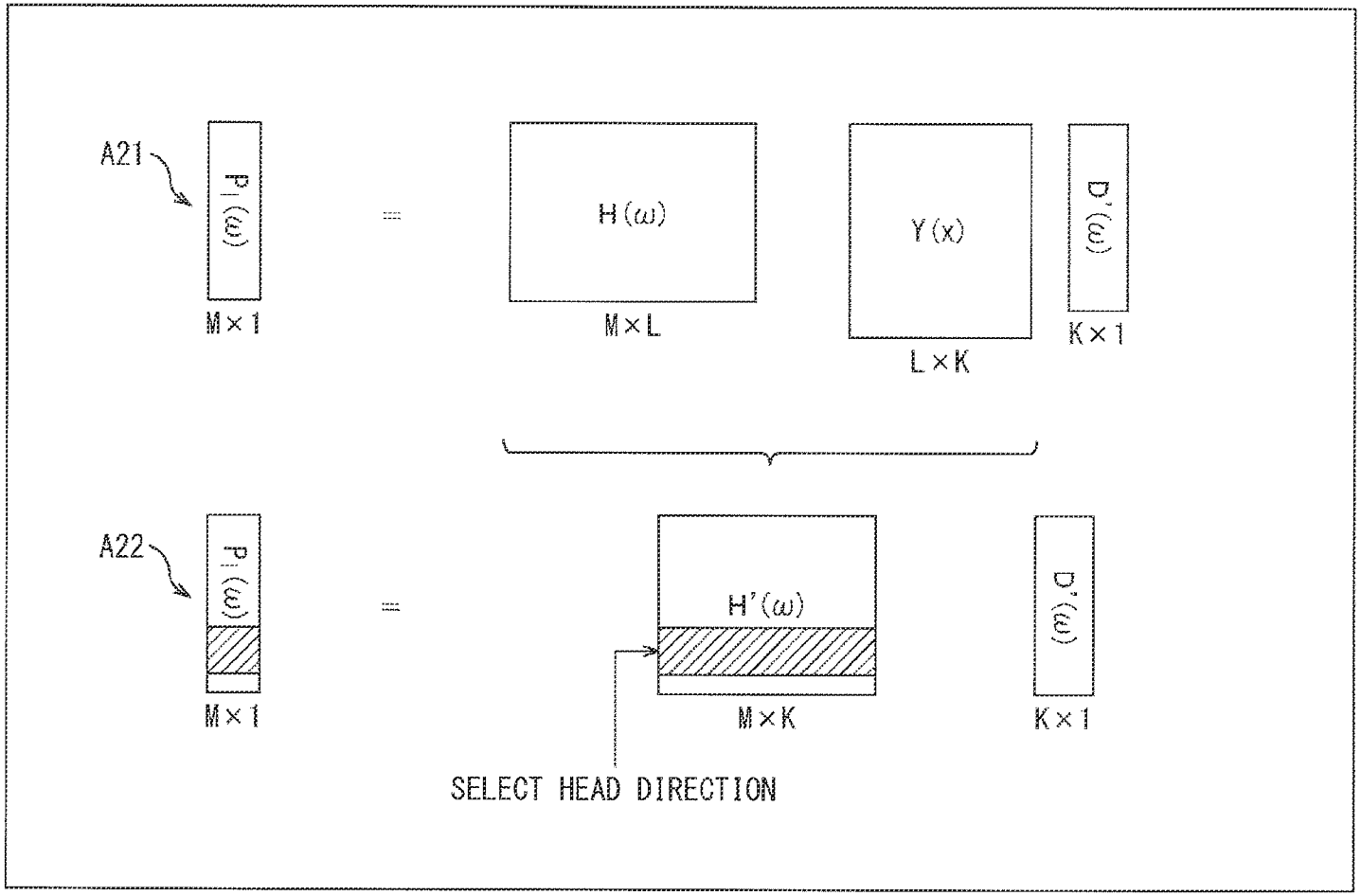
FIG. 4 is a diagram describing calculation of a drive signal in a second technique.

In such an operation expressed by the expression (18), the operation amount is reduced as illustrated in FIG. 4. That is, calculation expressed by the expression (12) is calculation to determine a product of the matrix $H(\omega)$ of M×L, the matrix Y(x) of L×K, and the vector $D'(\omega)$ of K×1 as indicated by an arrow A21 in FIG. 4.

Herein, $H(\omega)Y(x)$ is the matrix $H'(\omega)$ as defined in the expression (16); therefore, the calculation indicated by the arrow A21 eventually becomes as indicated by an arrow A22. In particular, it is possible to perform calculation for determining the matrix $H'(\omega)$ offline, that is, in advance; therefore, determining and holding the matrix $H'(\omega)$ in advance makes it possible to reduce the operation amount for determining the drive signals of the headphones online by that amount.

In a case where the matrix $H'(\omega)$ is thus determined in advance, the calculation indicated by the arrow A22, that is, the calculation of the expression (18) described above is performed to actually determine the drive signals of the headphones.

That is, as indicated by the arrow A22, the row corresponding to the direction $g_j$ of the head of the listener in the matrix $H'(\omega)$ is selected, and the drive signal $P_l(g_j, \omega)$ of the left headphone is calculated by a matrix operation of that selected row and the vector $D'(\omega)$ including the inputted input signal $D'_n{}^m(\omega)$. In FIG. 4, a hatched portion in the matrix $H'(\omega)$ represents the row corresponding to the direction $g_j$, and an element included in this row is the head-related transfer function $H'_n{}^m(g_j, \omega)$ expressed by the expression (18).

<About Third Technique>

Incidentally, in the second technique described above, while it is possible to greatly reduce the operation amount and the necessary memory amount, it is necessary to hold all the rotation directions of the head of the listener, that is, the rows corresponding to the respective directions $g_j$ in a memory as the matrix $H'(\omega)$ of the head-related transfer functions.

Accordingly, a matrix (vector) including the head-related transfer function of the spherical harmonic domain for one direction gj may be set as $H_s(\omega)=H'(g_j)$, and only the matrix $H_s(\omega)$ including the row corresponding to the one direction $g_j$ of the matrix $H'(\omega)$ may be held, and a rotation matrix $R'(g_i)$ for performing rotation corresponding to head rotation of the listener in the spherical harmonic domain may be held by the number of the plurality of directions $g_j$. Hereinafter, such a technique is referred to as third technique.

The rotation matrix $R'(g_j)$ of each of the directions $g_j$ is different from the matrix $H'(\omega)$ and has no time frequency dependence. This makes it possible to greatly reduce the memory amount as compared with making the matrix $H'(\omega)$ hold the component of the direction $g_j$ of rotation of the head.

First, a product $H'(g_i^{-1}, \omega)$ of a row $H(g_i^{-1}, \omega)$ corresponding to a predetermined direction $g_j$ of the matrix $H(\omega)$ and the matrix $Y(x)$ of the spherical harmonic function is considered as expressed by the following expression (19).

[Math. 19]

$$H'(g_j^{-1},\omega)=H(g_j^{-1}x,\omega)Y(x) \tag{19}$$

In the second technique described above, coordinates of the head-related transfer function used are rotated from x to $g_i^{-1}x$ for the direction $g_j$ of the rotation of the head of the listener. However, the same result is obtainable by rotating coordinates of the spherical harmonic function from x to $g_jx$ without changing the coordinates of the position x of the head-related transfer function. That is, the following expression (20) is established.

[Math. 20]

$$H'(g_j^{-1},\omega)=H(g_j^{-1}x,\omega)Y(x)=H(x,\omega)Y(g_jx) \tag{20}$$

Further, the matrix $Y(g_jx)$ of the spherical harmonic function is the product of the matrix $Y(x)$ and the rotation matrix $R'(g_j^{-1})$, and is as expressed by the following expression (21). It is to be noted that the rotation matrix $R'(g_j^{-1})$ is a matrix that rotates the coordinates by $g_j$ in the spherical harmonic domain.

[Math. 21]

$$Y(g_jx)=Y(x)R'(g_j^{-1}) \tag{21}$$

Herein, for the set Q expressed by the following expression (22), elements other than elements in rows $(n^2+n+1+k)$ and columns $(n^2+n+1+m+m)$ of the rotation matrix $R'(g_j)$, which are $(n^2+n+1+k)$ and $(n^2+n+1+m)$ belonging to Q, are zero.

[Math. 22]

$$Q=\{q|n^2+1\leq q\leq(n+1)^2,q,n\in\{0,1,2\ldots\}\} \tag{22}$$

Accordingly, it is possible to express the spherical harmonic function $Y_n^m(g_jx)$, which is an element of the matrix $Y(g_jx)$, by the following expression (23) using the element $R'(n)_{k,m}(g_j)$ in the $(n^2+n+1+k)$ rows and the $(n_2+n+1+m)$ columns of the rotation matrix $R'(g_i)$.

[Math. 23]

$$Y_n^m(g_jx)=\sum_{k=-n}^{n}Y_n^k(x)R'^{(n)}_{k,m}(g_j^{-1}) \tag{23}$$

Herein, the element $R'(n)_{k,m}(g_j)$ is expressed by the following expression (24).

[Math. 24]

$$R'_{k,m}{}^{(n)}(g_j)=e^{-im\phi}r_{k,m}{}^{(n)}(\theta)e^{-ik\psi} \tag{24}$$

In the expression (24), i represents a pure imaginary number, θ, φ, and ψ represent rotational angles of Euler angles of the rotation matrix, and $r^{(n)}{}_{k,m}(\theta)$ is expressed by the following expression (25).

[Math. 25]

$$r_{k,m}^{(n)}(\theta)=\sqrt{\frac{(n+k)!\,(n-k)!}{(n+m)!\,(n-m)!}}\sum_{\sigma}\binom{n+m}{n-k-\sigma}\binom{n-m}{\sigma}(-1)^{n-k-\sigma}\left(\cos\frac{\theta}{2}\right)^{2\sigma+k+m}\left(\sin\frac{\theta}{2}\right)^{2n-2\sigma-k-m} \tag{25}$$

From the above, a binaural reproducing signal reflecting the rotation of the head of the listener by using the rotation matrix $R'(g_j^{-1})$, for example, the drive signal $P_l(g_j, \omega)$ of the left headphone is obtained by calculating the following expression (26). In addition, in a case where the left and right head-related transfer functions are optionally considered to be symmetric, performing inversion is performed using a matrix $R_{ref}$ that makes either the matrix $D'(\omega)$ of the input signal or the row vector $H_s(\omega)$ of a left head-related transfer function horizontally flip as pre-processing of the expression (26), which makes it possible to obtain a right headphone drive signal only by holding the row vector $H_s(\omega)$ of the left head-related transfer function. Note that a case where different left and right head-related transfer functions are necessary is basically described below.

[Math. 26]

$$P_l(g_j,\omega)=H(g_j^{-1}x,\omega)Y(x)D'(\omega)=H(x,\omega)Y(x)R'(g_j^{-1})D'(\omega)=H_S(\omega)R'(g_j^{-1})D'(\omega) \tag{26}$$

In the expression (26), the drive signal $P_l(g_j, \omega)$ is determined by synthesizing the row vector $H_s(\omega)$, the rotation matrix $R'(g_j^{-1})$, and the vector $D'(\omega)$.

Figure 5:
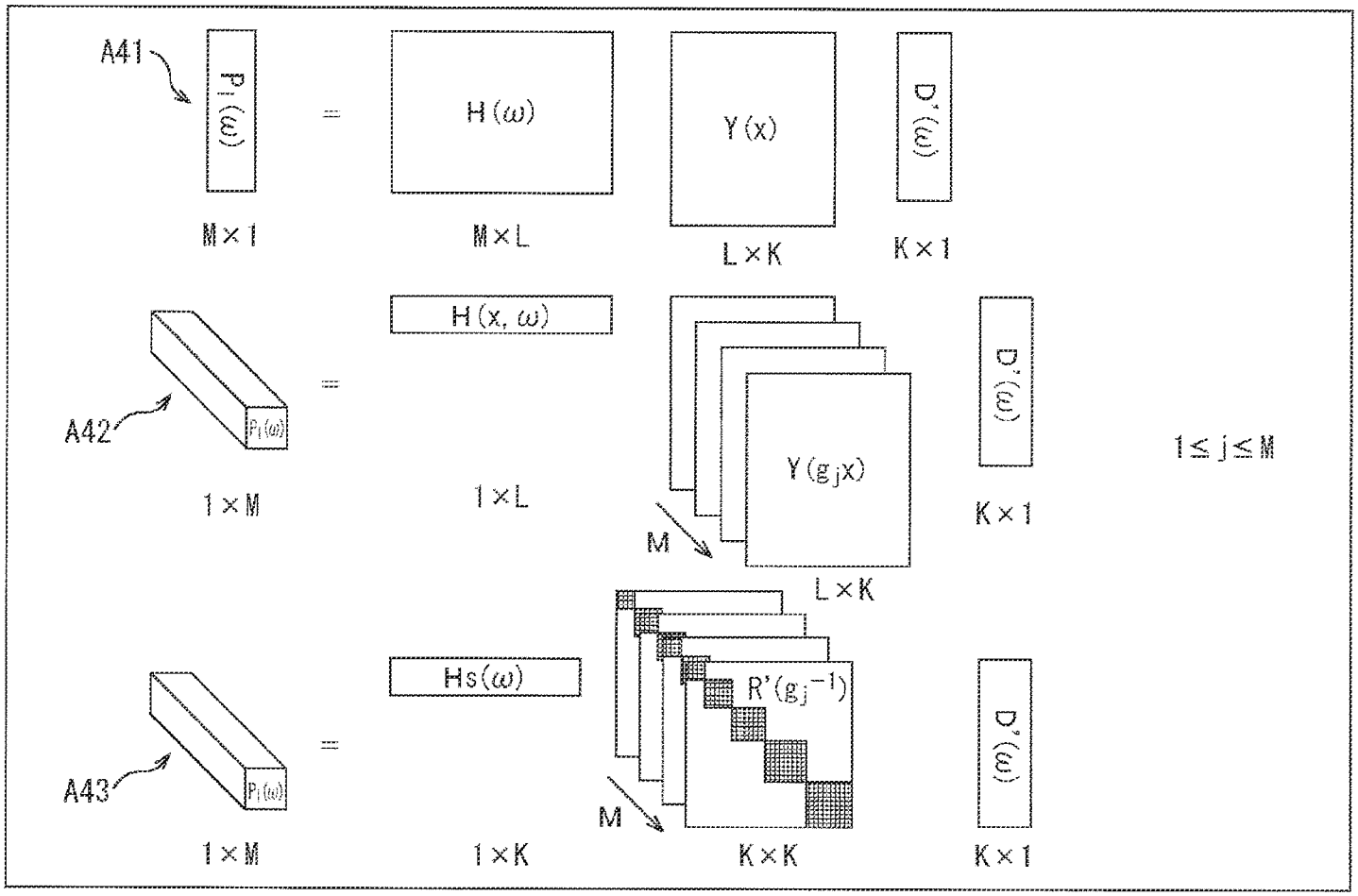
FIG. 5 is a diagram describing calculation of a drive signal in a third technique.

The calculation as described above is, for example, calculation illustrated in FIG. 5. That is, the vector $P_l(\omega)$ including the drive signal $P_l(g_j, \omega)$ of the left headphone is obtained by the product of the matrix $H(\omega)$ of M×L, the matrix $Y(x)$ of L×K, and the vector $D'(\omega)$ of K×1, as indicated by an arrow A41 in FIG. 5. This matrix operation is as expressed by the expression (12) described above.

This operation is represented by using the matrix $Y(g_jx)$ of the spherical harmonic function prepared for each of M number of directions $g_j$, as indicated by an arrow A42. That is, the vector $P_l(\omega)$ including the drive signal $P_l(g_j, \omega)$ corresponding to each of the M number of directions $g_j$ is obtained by the product of the predetermined row $H(x, \omega)$ of the matrix H(o)), the matrix $Y(g_jx)$, and the vector $D'(\omega)$ from a relationship expressed by the expression (20).

Herein, the row $H(x, \omega)$, which is a vector, is 1×L, the matrix $Y(g_jx)$ is L×K, and the vector $D'(\omega)$ is K×1. This is further transformed by using relationships expressed by the expressions (17) and (21), which is as indicated by an arrow A43. That is, as expressed by the expression (26), the vector NO is obtained by the product of the row vector $H_s(\omega)$ of 1×K, the rotation matrix $R'(g_j^{-1})$ of K×K of each of the M number of directions $g_j$, and the vector $D'(\omega)$ of K×1.

It is to be noted that, in FIG. 5, hatched portions of the rotation matrix $R'(g_j^{-1})$ represent non-zero elements of the rotation matrix $R'(g_j^{-1})$.

Figure 6:
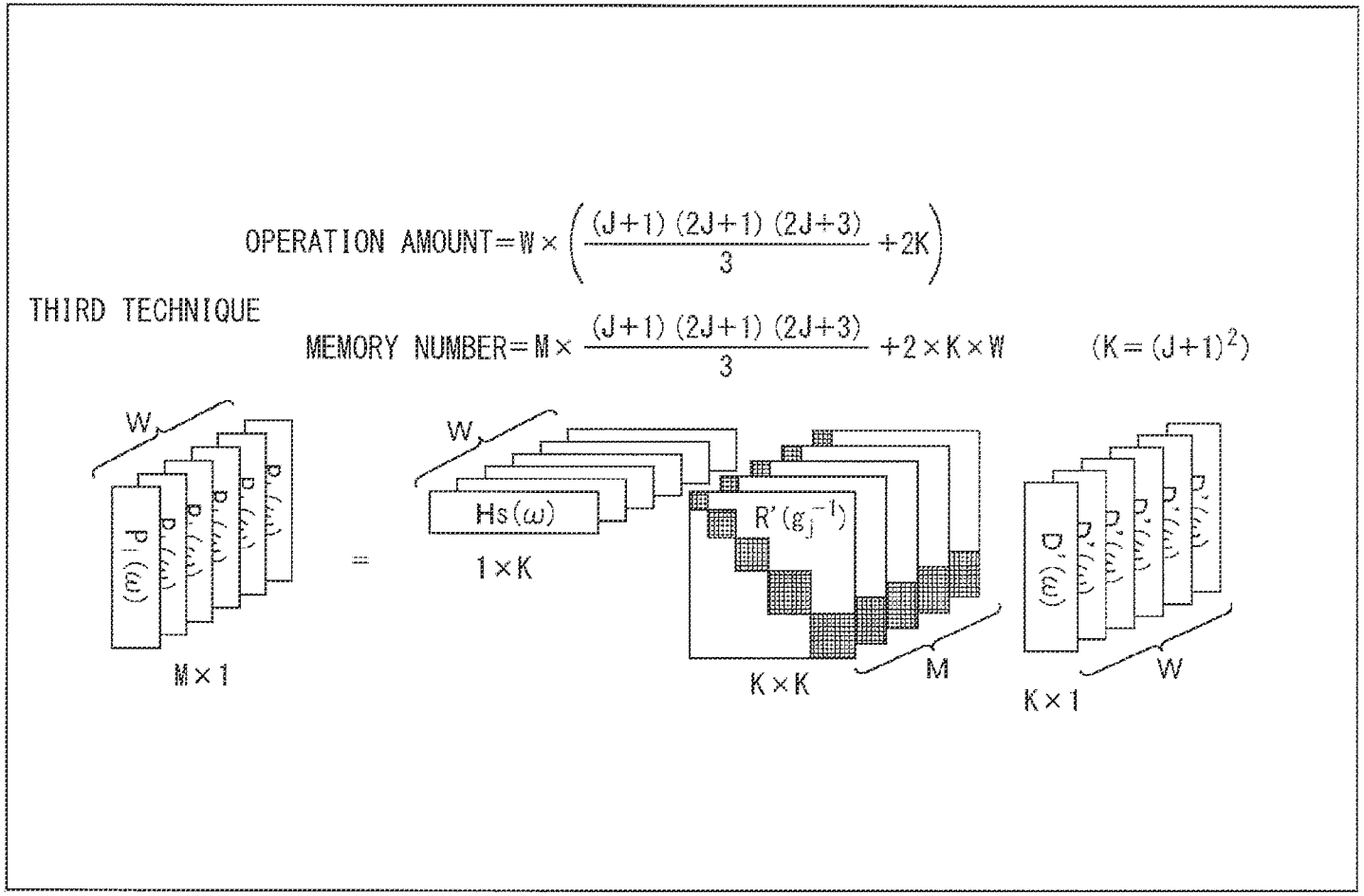
FIG. 6 is a diagram describing an operation amount and a necessary memory amount.

In addition, FIG. 6 illustrates the operation amount and the necessary memory amount in such a third technique.

That is, it is assumed that, as illustrated in FIG. 6, the row vector $H_s(\omega)$ of 1×K is prepared for each time frequency bin w, the rotation matrix $R'(g_j^{-1})$ of K×K is prepared for the M number of directions $g_j$, and the vector $D'(\omega)$ is K×1. In addition, it is assumed that the number of time frequency bins ω is W, and the maximum value of the degree n of the spherical harmonic function, that is, the maximum degree is J.

At this time, the number of non-zero elements of the rotation matrix $R'(g_j)$ is (J+1)(2J+1)(2J+3)/3; therefore, the total calc/W of the number of product-sum operations per time frequency bin ω in the third technique is as expressed by the following expression (27).

[Math. 27]

$$calc/W = \frac{(J+1)(2J+1)(2J+3)}{3} + 2K \tag{27}$$

In addition, in the operation by the third technique, it is necessary to hold the row vector $H_s(\omega)$ of 1×K for each time frequency bin ω for left and right ears, and further, it is necessary to hold non-zero elements of the rotation matrix $R'(g_j^{-1})$ for each of the M number of directions. Accordingly, a memory amount "memory" necessary for the operation by the third technique is as expressed by the following expression (28).

[Math. 28]

$$\text{memory} = M \times \frac{(J+1)(2J+1)(2J+3)}{3} + 2 \times K \times W \tag{28}$$

In the third technique, holding the number of non-zero elements of the rotation matrix $R'(g_j^{-1})$ makes it possible to greatly reduce the necessary memory amount as compared with the second technique.

<About Fourth Technique>

It is to be noted that, in the third technique, it is necessary to hold the rotation matrices $R'(g_j^{-1})$ for rotation of three axes of the head of the listener, that is, for optional M number of directions $g_j$. To hold such rotation matrices $R'(g_j^{-1})$, a certain memory amount is necessary, though the amount is less than that in a case of holding the matrix H'(ω) with time frequency dependence.

Accordingly, the rotation matrix $R'(g_j^{-1})$ for performing rotation about the head of the listener as a rotation center in the spherical harmonic domain may be sequentially determined at the time of an operation. Hereinafter, such a technique is also referred to as fourth technique.

Herein, it is possible to express a rotation matrix R'(g) by the following expression (29). In addition, g in the expression (29) is a rotation matrix, and is represented by the product of a matrix u(ϕ), a matrix a(ϕ), and a matrix u(ψ) as expressed by the following expression (30).

[Math. 29]

$$R'(g)=R'(u(\phi)a(\theta)u(\psi))=R'(u(\phi))R'(a(\theta))R'(u(\psi)) \tag{29}$$

[Math. 30]

$$g=u(\phi)a(\theta)u(\psi) \tag{30}$$

It is to be noted that, in the expression (29), a(θ) and u(ϕ) are rotation matrices that rotate coordinates by an angle θ and an angle ϕ about a coordinate axis as a rotation axis of a coordinate system in which the position of the head of the lister is an origin point. In addition, u(ψ) is a rotation matrix that is only different in the rotation angle from u(ϕ) and rotates the coordinates by an angle ψ about the same coordinate axis as the rotation axis. It is to be noted that rotation angles of the respective matrices u(ϕ), a(θ), and u(ψ), that is, the angle ϕ, the angle θ, and the angle ψ are Euler angles.

For example, it is assumed that there is an orthogonal coordinate system in which the position of the head of the listener is set as the origin point, and an x axis, a y axis, and a z axis orthogonal to each other are respective axes. Herein, in a state in which the listener is directed to front, a positive direction of the x axis is a direction of the front, and the z axis is an upward-downward direction viewed from the listener directed to the front, that is, an axis in a vertical direction. The angle ϕ, the angle θ, and the angle ψ are rotation angles to respective rotation directions relative to the state in which the listener is directed to the front, that is, to the positive direction of the x axis.

Specifically, the rotation angle of the head in a case where the head moves in the upward-downward direction about the y axis as the rotation axis while the listener seeing the front is the angle θ that is an elevation angle. Further, the rotation angle of the head in a case where the head moves in a horizontal direction viewed from the listener about the z axis as the rotation axis while the listener is directed to the front is the angle θ that is a horizontal angle.

The matrix a(θ) is a rotation matrix that rotates the coordinates (coordinate system) by the angle θ about the y axis as the rotation axis, and the matrix u(ϕ) is a rotation matrix that rotates the coordinates (coordinate system) by the angle ϕ about the z axis as the rotation axis. Specifically, these matrices a(θ) and u(ϕ) are as expressed by the following expressions (31) and (32), respectively.

[Math. 31]

$$\left\{ a(\theta) = \begin{pmatrix} \cos\theta & 0 & \sin\theta \\ 0 & 1 & 0 \\ -\sin\theta & 0 & \cos\theta \end{pmatrix} \middle| \theta \in [0, 2\pi] \right\} \tag{31}$$

[Math. 32]

$$\left\{ u(\phi) = \begin{pmatrix} \cos\phi & -\sin\phi & 0 \\ \sin\phi & \cos\phi & 0 \\ 0 & 0 & 1 \end{pmatrix} \middle| \phi \in [0, 2\pi] \right\} \tag{32}$$

Accordingly, for example, the matrix a(0) acts on an optional position $v=(v_x, v_y, v_z)^T$ in the coordinate system with the position of the head of the listener as the origin point, which makes it possible to give rotation about the y axis as the rotation axis to the position v. A position $v_2$ after the rotation of the position v is expressed by the following expression (33).

Similarly, the matrix u(ϕ) acts on the position v, which makes it possible to give rotation about the z axis as the rotation axis to the position v. A position $v_3$ after the rotation of the position v is expressed by the following expression (34).

[Math. 33]

$$v_2=a(\theta)v \tag{33}$$

[Math. 34]

$$v_3=u(\phi)v \tag{34}$$

Accordingly, the rotation matrix R'(g)=R'(u(ϕ)a(θ)u(ψ)) is a rotation matrix that, in the spherical harmonic domain, rotates the coordinate system by the angle $\phi$ in a horizontal angle direction, then rotates, by the angle $\theta$ in an elevation angle direction viewed from that coordinate system, the coordinate system rotated by the angle $\phi$, and further rotates, by the angle $\psi$ in the horizontal angle direction viewed from that coordinate system, the coordinate system rotated by the angle $\theta$.

In addition, $R'(u(\phi))$, $R'(a(\theta))$, and $R'(u(\psi))$ represent the rotation matrices $R'(g)$ in a case where the coordinates are rotated by rotations by the matrix $(u(\phi))$, the matrix $(a(\theta))$, and the matrix $(u(\psi))$, respectively.

In other words, the rotation matrix $R'(u(\phi))$ is a rotation matrix that rotates the coordinates by the angle $\phi$ in the horizontal angle direction in the spherical harmonic domain, and the rotation matrix $R'(a(\theta))$ is a rotation matrix that rotates the coordinates by the angle $\theta$ in the elevation angle direction in the spherical harmonic domain. In addition, the rotation matrix $R'(u(\psi))$ is a rotation matrix that rotates the coordinates by the angle $\psi$ in the horizontal angle direction in the spherical harmonic domain.

Figure 7:
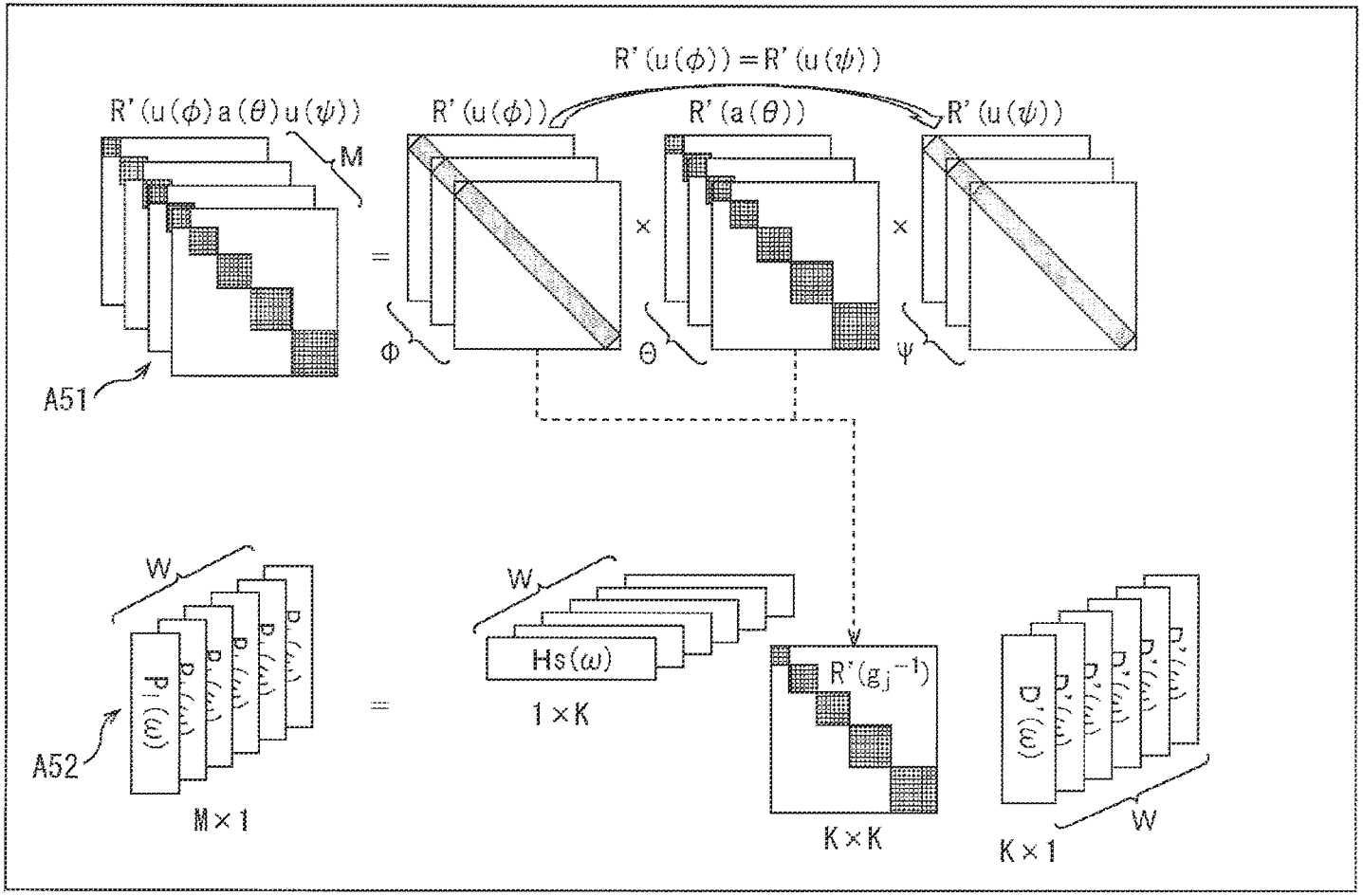
FIG. 7 is a diagram describing calculation of a drive signal in a fourth technique.

Thus, for example, as indicated by an arrow A51 in FIG. 7, it is possible to express the rotation matrix $R'(g)=R'(u(\phi)a(\theta)u(\psi))$, which rotates the coordinates three times by the angle $\phi$, the angle $\theta$, and the angle $\psi$ as rotation angles, by the product of three rotation matrices $R'(u(\phi))$, $R'(a(\theta))$, and $R'(u(\psi))$.

In this case, it is sufficient if, as data for obtaining the rotation matrix $R'(g_j^{-1})$, the rotation matrix $R'(u(\phi))$, the rotation matrix $R'(a(\theta))$, and the rotation matrix $R'(u(\psi))$ for the respective values of the rotation angles $\phi$, $\theta$, and $\psi$ are held in tables in the memory. In addition, in a case where the same head-related transfer function is optionally used for the left and the right, the row vector $H_s(\omega)$ is held for only one ear, and the matrix Rref described above for horizontal inversion is also held in advance, which makes it possible to obtain the rotation matrix for the other ear by determining the product of this and a generated rotation matrix.

In addition, in a case where the vector $P_l(\omega)$ is actually calculated, one rotation matrix $R'(g_j^{-1})$ is calculated by calculating the product of respective rotation matrices read out from tables. Then, as indicated by an arrow A52, the product of the matrix $H_s(\omega)$ of $1\times K$, the rotation matrix $R'(g_j^{-1})$ of $K\times K$ common to all the time frequency bins w, and the vector $D'(\omega)$ of $K\times 1$ is calculated for each of the time frequency bins w to determine the vector $P_l(\omega)$.

Herein, for example, in a case where the rotation matrix $R'(g_j^{-1})$ itself of each rotation angle is held in the table, it is necessary to hold $360^3=46656000$ rotation matrices $R'(g_j^{-1})$, where accuracy of the angle $\phi$, the angle $\theta$, and the angle $\psi$ of each rotation is one degree (1°).

In contrast, in a case where the rotation matrix $R'(u(\phi))$, the rotation matrix $R'(a(\theta))$, and the rotation matrix $R'(u(\psi))$ of each rotation angle are held in tables, it is necessary to hold only $360\times 3=1080$ rotation matrices, where accuracy of the angle $\theta$, the angle $\theta$, and the angle iv of each rotation is one degree (1°).

Accordingly, in a case where the rotation matrix $R'(g_j^{-1})$ itself is held, it is necessary to hold data of the order of $O(n^3)$. In contrast, in a case where the rotation matrix $R'(u(\phi))$, the rotation matrix $R'(a(\theta))$, and the rotation matrix $R'(u(\psi))$ are held, only data of the order of $O(n)$ is sufficient, which makes it possible to greatly reduce the memory amount.

Moreover, as indicated by the arrow A51, the rotation matrix $R'(u(\phi))$ and the rotation matrix $R'(u(\psi))$ are diagonal matrices; therefore, it is sufficient if only diagonal components are held.

In addition, the rotation matrix $R'(u(\phi))$ and the rotation matrix $R'(u(\psi))$ are both rotation matrices for performing rotation in the horizontal angle direction, which makes it possible to obtain the rotation matrix $R'(u(\phi))$ and the rotation matrix $R'(u(\psi))$ from the same common table. In other words, the table of the rotation matrix $R'(u(\phi))$ and the table of the rotation matrix $R'(u(\psi))$ may be the same.

It is to be noted that, in FIG. 7, hatched portions of the respective rotation matrices represent non-zero elements.

Further, for k and m in a case where $(n^2+n+1+k)$ and $(n^2+n+1+m)$ belong to the set Q expressed by the expression (22) described above, elements other than elements in rows $(n^2+n+1+k)$ and columns $(n^2+n+1+m+m)$ of the rotation matrix $R'(a(\theta))$ are zero; therefore, it is sufficient if only elements other than zero are held as the rotation matrix $R'(a(\theta))$, which makes it possible to further reduce the memory amount.

From the above, it is possible to further reduce the memory amount necessary to hold data for obtaining the rotation matrix $R'(g_j^{-1})$.

Specifically, for example, in a case where $\Phi$ number of rotation matrices $R'(u(\phi))$, $\Theta$ number of rotation matrices $R'(a(\theta))$, and $\Psi$ number of rotation matrices $R'(u(\psi))$ are held, the number M of rotation directions $g_j$ of the head becomes $M=\Phi\times\Theta\times\Psi$.

In the fourth technique, the rotation matrices $R'(a(\theta))$ are held by accuracy of the angle $\theta$, that is, the $\Theta$ number of rotation matrices $R'(a(\theta))$ are held; therefore, the memory amount necessary to hold the rotation matrices $R'(a(\theta))$ is $memory(a)=\Theta\times x(J+1)(2J+1)(2J+3)/3$.

In addition, for the rotation matrix $R'(u(\phi))$ and the rotation matrix $R'(u(\psi))$, it is possible to use a common table, and in a case where the accuracy of the angle $\phi$ and the angle $\psi$ are the same, it is sufficient if rotation matrices are held only by the angle $\theta$, that is, the $\Phi$ number of rotation matrices are held, and it is sufficient if only the diagonal components of these rotation matrices are held. Accordingly, assuming that a length of the vector $D'(\omega)$ is K, the memory amount necessary to hold the rotation matrices $R'(u(\phi))$ and the rotation matrices $R'(u(\psi))$ is $memory(b)=\Phi\times K$.

Further, assuming that the number of time frequency bins $\omega$ is W, the memory amount necessary to hold the row vector $H_s(\omega)$ of $1\times K$ by the time frequency bins w for the left and right ears is $2\times K\times W$.

Accordingly, as the sum of these memory amounts, the memory amount necessary in the fourth technique is the memory amount memory=memory(a)+memory(b)+2KW.

Such a fourth technique makes it possible to greatly reduce the memory amount necessary for the operation amount substantially the same as that in the third technique. Specifically, the fourth technique exerts more effects, for example, in a case where the accuracy of the angle $\phi$, the angle $\theta$, and the angle $\psi$ is set to one degree (1°) or the like to withstand practical use in realizing a head tracking function.

<About Proposed Technique 1>

Incidentally, in the fourth technique, it is possible to reduce, to 1080, the number of rotation matrices to be held, for example, by having rotation with respect to three axes at every one degree, that is, by setting the accuracy of the angle $\phi$, the angle $\theta$, and the angle $\psi$ to one degree (1°).

However, in the fourth technique, in terms of the operation amount, it is possible to reduce the maximum degree J of the degree n of the spherical harmonic function only to the cube order.

Figure 8:
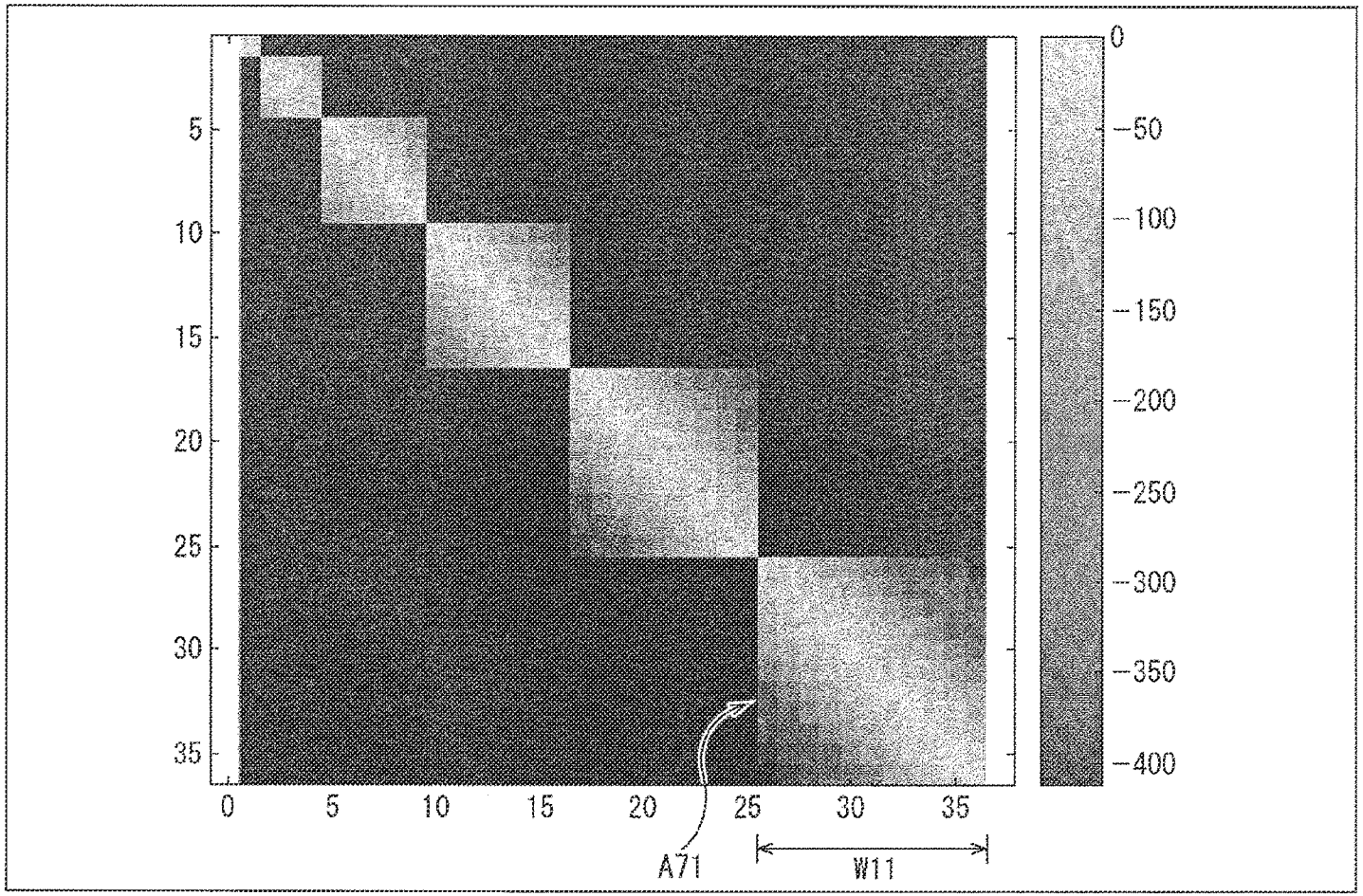
FIG. 8 is a diagram describing a rotation matrix.

The reason for this is that the rotation matrix R'(a(θ)) for tracking rotation of the head of the listener (user) is a block diagonal matrix as illustrated in FIG. 8, for example.

It is to be noted that, in FIG. 8, a horizontal axis represents components of a column of the rotation matrix R'(a(θ)), and a vertical axis represents components of a row of rotation matrix R'(a(θ)). In addition, in FIG. 8, shades of gray at respective positions of the rotation matrix R'(a(θ)) indicate levels (dB) of elements corresponding to these positions of the rotation matrix R'(a(θ))

FIG. 8 illustrates the rotation matrix R'(a(θ)) in a case where the rotation angle θ is one degree. In this example, in a case where attention is focused on elements having a value of −400 dB or more, for example, in the rotation matrix R'(a(θ)), a portion including elements having such a value is a block having a size of (2n+1)(2n+1) for the degree n. For example, a square portion indicated by an arrow A71 is a portion of one block of a block diagonal matrix, and a width (thickness) W11 of the block is 2n+1. That is, in the square portion indicated by the arrow A71, (2n+1) elements are arranged in a row direction, and (2n+1) elements are also arranged in a column direction.

Using the rotation matrix R'(a(θ)) that is such a block diagonal matrix makes it possible to reduce the operation amount to some extent, but if it is possible to further reduce the operation amount, it is possible to obtain the drive signal more quickly and efficiently.

Accordingly, the present technology focuses on characteristics of the rotation matrix for minute rotation, and performing tracking of rotation of the head of the listener (user) by accumulation of the minute rotations makes it possible to reduce the operation amount to the square order of the degree J.

The technique of the present technology (hereinafter also referred to as proposed technique 1) is described in detail below.

Of rotation of three axes of the head of the listener, that is, the rotation matrix R'(u(ϕ)), the rotation matrix R'(a(θ)), and the rotation matrix R'(u(ψ)), only the rotation matrix R'(a(θ)) is a block diagonal matrix, and the other rotation matrices R'(u(ϕ)) and R'(u(ψ)) are fully diagonal matrices.

However, depending on how a rotation axis is selected, two or more rotation matrices may become block diagonal matrices in some cases. In an example of this specification, a rotation axis that causes two or more rotation matrices to become block diagonal matrices is not used, but the present technique is applicable to a case where two or more rotation matrices are block diagonal matrices.

It is assumed that the angle θ is 0 degrees in a case where the listener is directed to the direction of the front in the upward-downward direction (the vertical direction), that is, in the elevation angle direction.

The angle θ becomes one degree in a case where the listener moves his head from a state in which the angle θ is 0 degrees to an upward direction (to a positive direction of the z axis) by +1 degree, i.e., rotates his head about the y axis as the rotation axis to the positive direction of the z axis by +1 degree.

The rotation matrix R'(a(θ)) in such a case where the angle θ is one degree is as illustrated in FIG. 8 as described above.

In the example illustrated in FIG. 8, it can be seen that the rotation matrix R'(a(θ)) is a block diagonal matrix, and a portion of each block of the block diagonal matrix is a square including (2n+1) elements on one side for each degree n. At the same time, the rotation matrix R'(g) that is a synthesis of the rotation matrix R'(a(θ)), rotation matrix R'(u(ϕ)), which is a diagonal matrix, and the rotation matrix R'(u(ψ)), which is a diagonal matrix, is also a similar block diagonal matrix. Herein, the direction $g_j$ may be a discrete value or a continuous value; therefore, $g_j$ is hereinafter simply referred to as g.

Now, in a case where the head-related transfer function in the spherical harmonic domain is rotated for one block of the rotation matrix R'(g) that is a block diagonal matrix, that is, for a certain degree n, the head-related transfer function $H'_n{}^m(g^{-1})$ after the rotation becomes as expressed by the following expression (35). That is, in a case where the head-related transfer function in the spherical harmonic domain is rotated by the angle of the direction g using a portion of a block of the degree n of the rotation matrix R'(g), the head-related transfer function $H'_n{}^m(g^{-1})$ after the rotation becomes as expressed by the following expression (35).

[Math. 35]

$$H_n'^m(g^{-1}) = \sum_{k=-n}^{n} H_n'^k R_{k,m}'^{(n)}(g) \tag{35}$$

In the expression (35), k represents an order before the rotation, and m represents an order after the rotation. In addition, $H'_n{}^k$ represents elements of the degree n and the order k in the row vector $H_s(\omega)$.

It can be seen from such calculation of the expression (35) that all (2n+1) elements $R'^{(n)}_{k,m}(g)$ are used to determine the element of the order m after one rotation.

However, in a case where the angle θ is minute, such as a case of the angle θ=one degree, most of the respective elements of the rotation matrix R'(a(θ)) that is a block diagonal matrix have a minute value. Accordingly, most of the elements $R'^{(n)}_{k,m}(g)$ of the rotation matrix R'(g) have a minute value.

Figure 9:
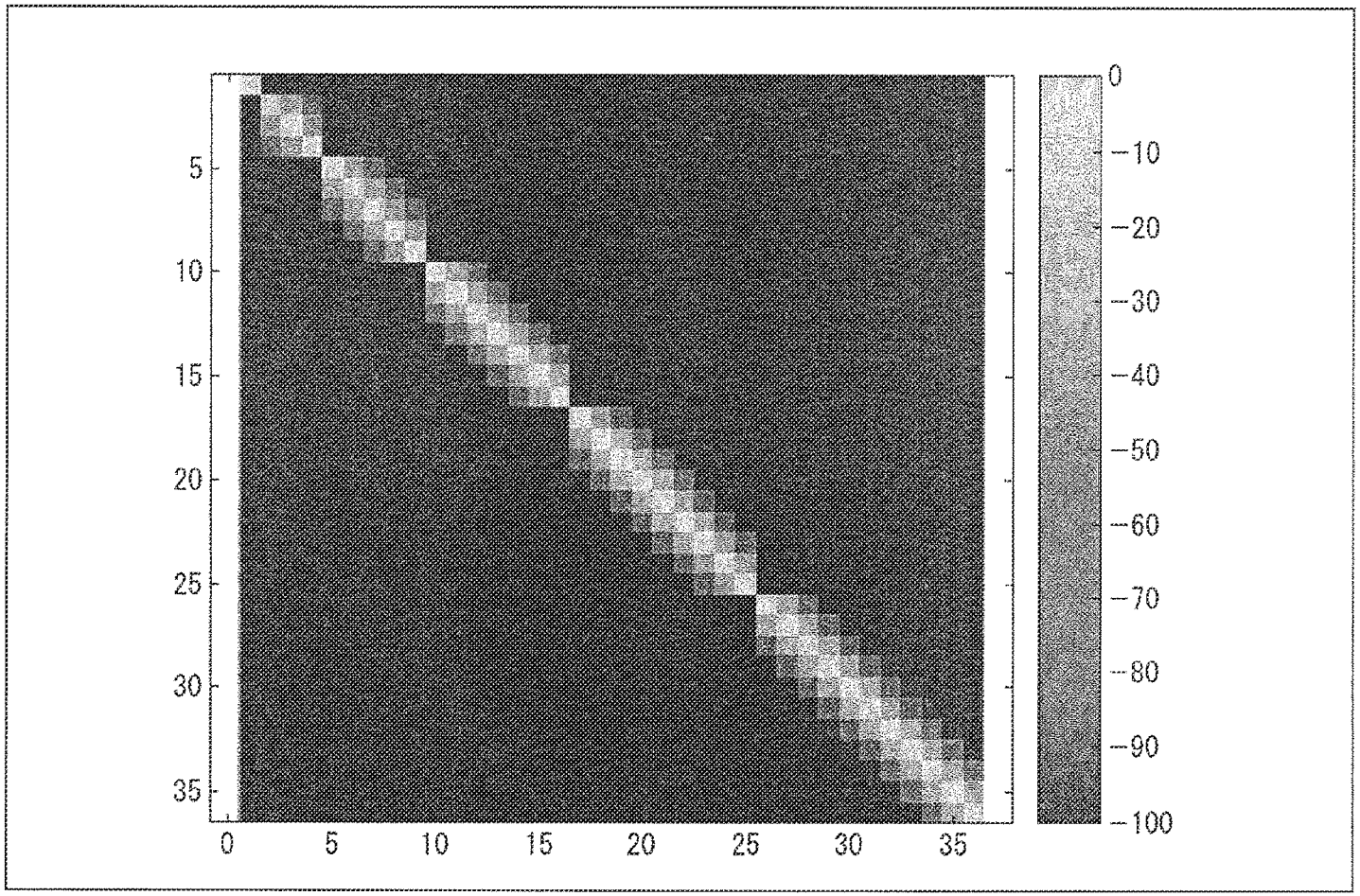
FIG. 9 is a diagram describing the rotation matrix.

That is, for example, the rotation matrix R'(a(θ)) illustrated in FIG. 9 indicates the rotation matrix R'(a(θ)) in a case where the angle θ is one degree that is the same as the rotation matrix R'(a(θ)) illustrated in FIG. 8.

That is, in FIG. 9, a horizontal axis represents components of a column of the rotation matrix R'(a(θ)), and a vertical axis represents components of a row of rotation matrix R'(a(θ)).

In addition, shades of gray at respective positions of the rotation matrix R'(a(θ)) indicate levels (dB) of elements corresponding to these positions of the rotation matrix R'(a(θ)).

However, in FIG. 8, a range of the level of each element of the rotation matrix R'(a(θ)) is from −400 dB to 0 dB, whereas, in FIG. 9, the range of the level of each element of the rotation matrix R'(a(θ)) is limited to a range from −100 dB to 0 dB.

As with an example illustrated in FIG. 9, in a case where an element having an effective value in the rotation matrix R'(a(θ)) is an element having a level of −100 dB to 0 dB, it can be seen that the element having the effective value exists only in the vicinity of diagonal components.

Further, it can be seen that the number of elements having the effective value in one focused row of the rotation matrix R'(a(θ)), that is, the number of elements having the effective value (hereinafter also referred to as effective element width) that are continuously disposed side by side in a lateral direction in FIG. 9 is almost the same in all degrees n.

Accordingly, the number of elements having an effective value in each degree n is only on the square order of J, which is nearly the maximum value of the degree n, even though the degree n increases.

Therefore, the element having a value within a range of a predetermined level, such as an element having a level of −100 dB to 0 dB of the rotation matrix R'(a(θ)) is set as an effective element, and only the effective element is used to perform an operation of rotating the head-related transfer function in the spherical harmonic domain, which makes it possible to reduce the operation amount. In other words, an element having a value within a range of a predetermined level of the rotation matrix R'(g) is set as an effective element, and only the effective element is used to perform the operation of rotating the head-related transfer function in the spherical harmonic domain, which make is possible to reduce the operation amount. The effective element width of the rotation matrix R'(g) is the same as the effective element width of the rotation matrix R'(a(θ)).

For example, in a case where the effective element width is 2C+1, calculation of the expression (35) described above is as expressed by the following expression (36).

[Math. 36]

$$H_n^{'m}(g^{-1}) \cong \sum_{k=max(-n,m-C)}^{min(n,m+C)} H_n^{'k} R_{k,m}^{'(n)}(g) \tag{36}$$

Note that, in the expression (36), min(a, b) represents a function that selects a smaller one of a and b. In the expression (36), max(a, b) represents a function that selects a larger one of a and b.

In the expression (35), (2n+1) elements $R'^{(n)}_{k,m}(g)$ of the order k ranging from n to n are used for each degree n, but only (2C+1) elements $R'^{(n)}_{k,m}(g)$ of the order k ranging from m−C to m+C, where m is set as a center, are used in calculation of the expression (36), thereby achieving a reduction in the operation amount. It is to be noted that, in a case where k is larger than n and in a case where k is smaller than −n, an operation is performed for k up to n and k up to −n, respectively, not to exceed a matrix range. The operation in which the order k is limited is performed in such a manner, that is, the operation is performed only on elements in which the order k has a value within a range determined by C, which makes it possible to reduce the operation amount.

In this case, the effective element width of 2C+1 is the same in all degrees n; therefore, it can be seen that the larger the degree J, the more advantageous the proposed technique 1 is in terms of the operation, as compared with the fourth technique described above.

It is to be noted that, in the expression (36), a constant C determined from the effective element width is applied to all degrees n. However, C determining the effective element width of 2C+1 is not limited to a constant, and a function C(n) of the degree n (where C(n)<n) may be used as C, or a function C(n, k) of the degree n and the order k may be used as C. Herein, it is sufficient if the function C(n) or the function C(n, k) is a natural number smaller than the degree n. In other words, it is sufficient if the operation is performed with the number of elements even slightly smaller than that in the operation using the elements of an entire block of the rotation matrix R'(a(θ)), which is a block diagonal matrix, that is, the rotation matrix R'(g).

In addition, the element used in the operation of the rotation matrix R'(a(θ)) may be an element itself of the rotation matrix R'(a(θ)) or may be an approximate value of the element of the rotation matrix R'(a(θ)).

That is, more generally, it is assumed that it is possible to express the rotation matrix R'(a(θ)) as R'(a(θ))=A1+A2+A3+ . . . by combining a certain plurality of matrices. In this case, for an approximate rotation matrix Rs'(a(θ)) represented by the sum of some extracted ones of matrices included in the rotation matrix R'(a(θ)), an operation may be performed using a smaller number of elements than (2n+1)×(2n+1) elements in each of n-th order blocks.

For example, it is possible to express an n-th order block diagonal matrix $R'^{(n)}(\beta)$ of the rotation matrix R'(a(θ)) by the following expression (37).

[Math. 37]

$$R'^{(n)}(\beta) = \exp S_n(\beta) = \frac{S_n(\beta)^0}{0!} + \frac{S_n(\beta)^1}{1!} + \frac{S_n(\beta)^2}{2!} + \frac{S_n(\beta)^3}{3!} + \ldots \tag{37}$$

Herein, a matrix $S_n(\beta)$ in the expression (37) is expressed by the following expression (38). In a case where a thickness of the approximate rotation matrix Rs'(a(θ)) is desired to be C with use of this matrix $S_n(\beta)$, it is sufficient if calculation is limited to calculation up to the C-th power in a polynomial of the matrix expressed by the expression (37).

[Math. 38]

$$S_n(\beta) = \frac{\beta}{2}\begin{pmatrix} 0 & \sqrt{1(2n)} & 0 & & 0 \\ -\sqrt{(2n-1)} & 0 & \sqrt{2(2n-1)} & & 0 \\ 0 & -\sqrt{(2n-1)2} & 0 & & \vdots \\ \vdots & & \vdots & \sqrt{(2n-1)2} & 0 \\ 0 & & -\sqrt{2(2n-1)} & & \sqrt{(2n)1} \\ 0 & & & -\sqrt{1(2n)} & \end{pmatrix} \tag{38}$$

By doing so, in the rotation matrix Rs'(a(θ)) used as the rotation matrix R'(a(θ)), elements having a non-zero value are almost only diagonal components. Accordingly, a rotation operation that causes the head-related transfer function to be rotated using the non-zero element of the rotation matrix R'(g) obtained with use of the rotation matrix Rs'(a(θ)), that is, an matrix operation of the rotation matrix R'(g) and the row vector $H_s(\omega)$ is performed, resulting in performing an operation in which the order of the rotation matrix R'(g) is limited, which makes it possible to reduce the operation amount.

It is to be noted that, in this case, for example, the rotation matrix $R'(u(\phi))$, the rotation matrix $Rs'(a(\theta))$, and the rotation matrix $R'(u(\psi))$ are synthesized to form the rotation matrix $R'(g)$, and a matrix operation in which the order is limited is performed.

In a case where tracking of the rotation of the head of the listener is performed by the proposed technique 1 as described above, it is assumed that, for example, the listener has rotated his head by 30 degrees in the upward direction, that is, in the elevation angle direction. That is, it is assumed that the elevation angle (the angle $\theta$) indicating the direction of the head of the listener has become 30 degrees.

Figure 10:
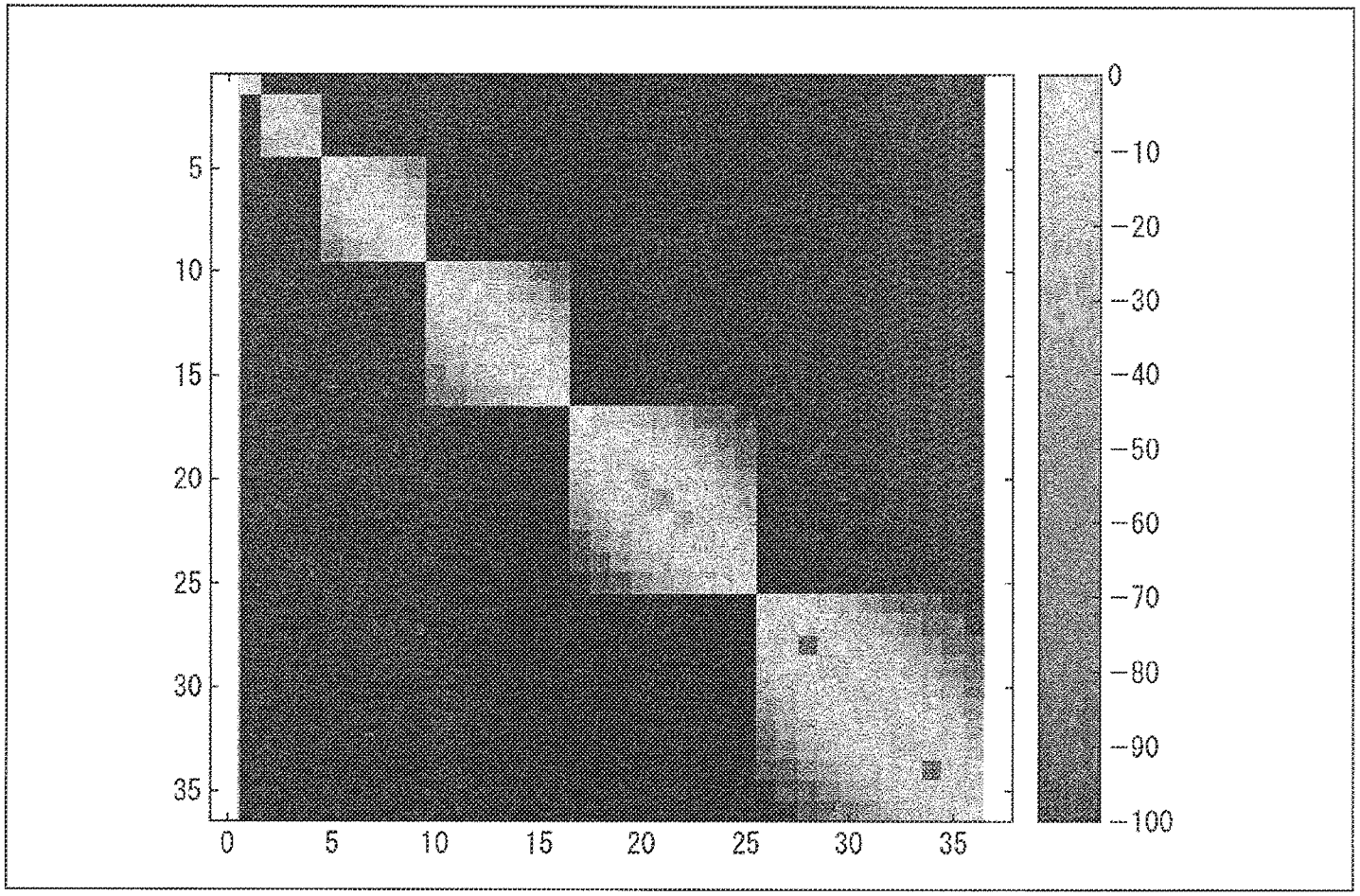
FIG. 10 is a diagram describing the rotation matrix.

In this case, the rotation matrix $R'(a(\theta))$ becomes as illustrated in FIG. 10. It is to be noted that, in FIG. 10, a horizontal axis represents components of a column of the rotation matrix $R'(a(\theta))$, and a vertical axis represents components of a row of rotation matrix $R'(a(\theta))$. In addition, in FIG. 8, shades of gray at respective positions of the rotation matrix $R'(a(\theta))$ indicate levels (dB) of elements corresponding to these positions of the rotation matrix $R'(a(\theta))$.

In FIG. 10, similarly to the case in FIG. 9, the range of the level of each element of the rotation matrix $R'(a(\theta))$ is limited to a range from −100 dB to 0 dB.

However, in an example illustrated in FIG. 10, the larger the degree n, the thicker (larger) the effective element width of a block for that degree n becomes. That is, even if components of −100 dB or less are truncated, the rotation matrix $R'(a(\theta))$ becomes a block-diagonal matrix having a thick effective element width.

As described above, in the rotation matrix $R'(a(\theta))$, in a case where the rotation angle $\theta$ is small, the effective element width is narrow, which makes it possible to reduce the operation amount as described with reference to FIG. 9, but the effective element width becomes thicker with an increase in the rotation angle $\theta$, which reduces an effect of reducing the operation amount.

In addition, in this state, it is necessary to increase the constant C that determines the effective element width 2C+1 as the head of the listener rotates more in the elevation angle direction.

In order to track rotation of the head up to a large rotation angle $\theta$ in the elevation angle direction while keeping the operation amount small, it is sufficient if accumulation of minute rotations is used.

That is, for example, the direction of the head of the listener (user) at a predetermined time is expressed by ($\phi$, $\theta$, $\psi$) using the Euler angles. Herein, the angle $\phi$, the angle $\theta$, and the angle $\psi$ respectively correspond to the rotation angle $\phi$, the rotation angle $\theta$, and the rotation angle $\psi$ described above. It is to be noted that, herein, the direction g that is the rotation direction of the head of the listener is represented by the Euler angles, but may be represented by, for example, another method such as a quarternion. In the following description, unless otherwise specified, the direction g is represented with use of the Euler angles.

Specifically, the angle $\phi$ and the angle $\psi$ are horizontal angles viewed from the listener, and the angle $\theta$ is an elevation angle viewed from the listener. Specifically, the angle $\theta$ at a time t is hereinafter referred to as angle $\theta_t$. Similarly, the angle $\phi$ and the angle $\psi$ at the time t are hereinafter referred to as the angle $\phi_t$ and the angle $\psi_t$, respectively.

In a case where accumulation of the minute rotations is used, it is sufficient if the rotation matrix $R'(g_t)$ is updated by determining a difference $\Delta g_t = g_t g_{t-1}^{-1}$ between the angle $g_t$ indicating the direction g at the time t and an angle $g_{t-1}$ at a time (t−1) immediately before the time t, that is, the time (t−1) before the time t, and rotating a previously obtained rotation matrix $R'(g_{t-1})$ by the difference $\Delta g_t$. That is, it is sufficient if the product of the previously obtained rotation matrix $R'(g_{t-1})$ at the time (t−1) and the rotation matrix $R'(\Delta g_t)$ corresponding to the difference $\Delta g_t$ is defined as the rotation matrix $R'(g_t)$ at the time t.

This make it possible to obtain the rotation matrix $R'(g_t)$ with a smaller operation amount with use of the rotation matrix $R'(\Delta g_t) = R'(u(\Delta\phi_t))R'(a(\Delta\theta_t))R'(u(\Delta\psi_t))$. The rotation matrix $R'(\Delta g_t)$ is obtained by synthesizing a rotation matrix $R'(a(\Delta\theta_t))$ in which the effective component width is narrow for a difference $\Delta\theta_t$ of the difference $\Delta g_t$, a rotation matrix $R'(u(\Delta\phi_t))$ that is a diagonal matrix for a difference $\Delta\theta_t$ of the difference $\Delta g_t$, and a rotation matrix $R'(u(\Delta\psi_t))$ that is a diagonal matrix for a difference $\Delta\psi_t$ of the difference $\Delta g_t$. The difference $\Delta g_t$ is a minute rotational angle.

It is to be noted that the difference $\Delta\theta_t$ is a difference between the angle $\theta_t$ and the angle $\theta_{t-1}$, that is, a difference $\Delta\theta_t = \theta_t - \theta_{t-1}$. Similarly, the difference $\Delta\theta_t$ is a difference between the angle $\theta_t$ and the angle $\Delta\theta_{t-1}$, and the difference $\Delta\psi_t$ is a difference between the angle $\psi_t$ and the angle $\Delta\psi_{t-1}$.

<Configuration Example of Audio Processor>

Figure 11:
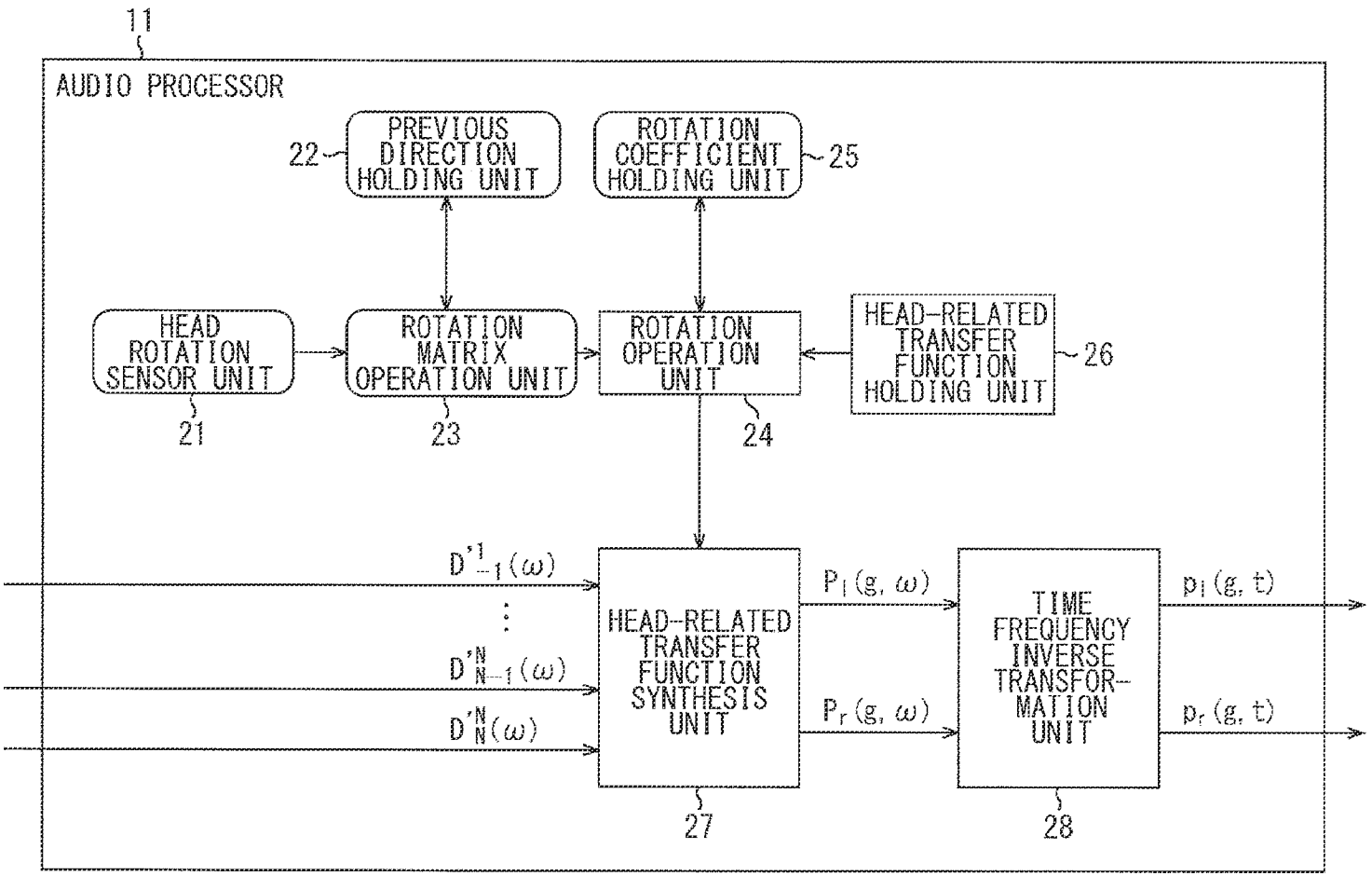
FIG. 11 is a diagram illustrating a configuration example of an audio processor.

Herein, description is given of an audio processor to which the present technology described above is applied. FIG. 11 is a diagram illustrating a configuration example of an embodiment of the audio processor to which the present technology is applied.

An audio processor 11 illustrated in FIG. 11 is a signal processing device that is incorporated in, for example, headphones or the like, and receives the input signal $D'_n{}^m(\omega)$ of the spherical harmonic domain, which is an acoustic signal of sound to be reproduced, and outputs drive signals of two-channel sound of a time domain. It is to be noted that, although description is given of a case where the audio processor 11 is incorporated in the headphones, the audio processor 11 may be incorporated in any other device different from the headphones, or may be any other device different from the headphones or the like.

The audio processor 11 includes a head rotation sensor unit 21, a previous direction holding unit 22, a rotation matrix operation unit 23, a rotation operation unit 24, a rotation coefficient holding unit 25, a head-related transfer function holding unit 26, a head-related transfer function synthesis unit 27, and a time frequency inverse transformation unit 28.

The head rotation sensor unit 21 includes, for example, an acceleration sensor, an image sensor, and the like attached to the head of the listener (user) as necessary. The head rotation sensor unit 21 detects rotation (movement) of the head of the listener, and supplies a detection result to the rotation matrix operation unit 23.

It is to be noted that the listener herein refers to a user who wears headphones, that is, a user who listens to sound reproduced by headphones on the basis of drive signals of left and right headphones obtained by the time frequency inverse transformation unit 28.

In the head rotation sensor unit 21, the angle $\phi_t$, the angle $\theta_t$, and the angle $\psi_t$ at the time t that is the current time are obtained as a result of detecting the rotation of the head of the listener, that is, a direction in which the head of the listener is directed. Hereinafter, information that includes the angle $\phi_t$, the angle $\theta_t$, and the angle $\psi_t$ and indicates the direction (rotation) of the head of the listener is also referred to as head rotation information. The direction at a certain time t indicated by the head rotation information is the angle $g_t$ corresponding to the direction g described above, and is angle information that indicates the direction of the head with reference to the x-axis direction, for example.

The previous direction holding unit 22 holds angles at each time supplied from the rotation matrix operation unit 23 as previous direction information, and supplies the previous direction information held at a time subsequent to the time to the rotation matrix operation unit 23. Accordingly, for example, in a case where the head rotational information at the time t is supplied from the head rotation sensor unit 21 to the rotation matrix operation unit 23, the angle $g_{t-1}$ at the time t−1 is supplied as the previous direction information from the previous direction holding unit 22 to the rotation matrix operation unit 23.

The rotation matrix operation unit 23 holds a table indicating the rotation matrix $R'(u(\phi))$ at each angle $\phi$ and a table indicating the rotation matrix $R'(a(\theta))$ at each angle $\theta$. It is to be noted that the table indicating the rotation matrix $R'(u(\phi))$ is also used to determine the rotation matrix $R'(u(\psi))$. That is, a common table is used for the rotation matrix $R'(u(\phi))$ and the rotation matrix $R'(u(\psi))$.

The rotation matrix operation unit 23 determines and outputs the rotation matrix $R'(u(\Delta\phi_t))$, the rotation matrix $R'(a(\Delta\theta_t))$, and the rotation matrix $R'(u(\Delta\psi_t))$ on the basis of the held tables, the head rotational information supplied from the head rotation sensor unit 21, and the previous direction information supplied from the previous direction holding unit 22. The rotation matrix operation unit 23 supplies the rotation matrix $R'(u(\Delta\phi_t))$, the rotation matrix $R'(a(\Delta\theta_t))$, and the rotation matrix $R'(u(\Delta\psi_t))$ to the rotation operation unit 24.

The rotation matrix $R'(\Delta g_t)$ that is a synthesis of the rotation matrix $R'(u(\Delta\phi_t))$, the rotation matrix $R'(a(\Delta\theta_t))$, and the rotation matrix $R'(u(\Delta\psi_t))$ is a rotation matrix for performing rotation by an angle of a difference (the difference $\Delta g_t$) between rotation $g_t$ of the head of the listener at the time t and rotation $g_{t-1}$ of the head of the listener at the time (t−1).

It is to be noted that, for the rotation matrix $R'(u(\Delta\phi_t))$, the rotation matrix $R'(a(\Delta\theta_t))$, and the rotation matrix $R'(u(\Delta\psi_t))$, the rotation matrix operation unit 23 may determine, without using the tables, the rotation matrix $R'(u(\Delta\phi_t))$, the rotation matrix $R'(a(\Delta\theta_t))$, and the rotation matrix $R'(u(\Delta\psi_t))$ by an operation on the basis of the difference $\Delta\phi_t$, the difference $\Delta\theta_t$, and the difference $\Delta\psi_t$. In addition, the table of rotation matrix $R'(a(\Delta\theta_t))$ may indicate the rotation matrix $Rs'(a(\Delta\theta_t))$ that is an approximation of the rotation matrix $R'(a(\Delta\theta_t))$, or the rotation matrix $Rs'(a(\Delta\theta_t))$ may be determined not from the tables but by an operation.

In addition, the rotation matrix operation unit 23 supplies head rotation information $g_t$ supplied from the head rotation sensor unit 21 as previous direction information to the previous direction holding unit 22 and causes the previous direction holding unit 22 to hold the head rotation information $g_t$.

The rotation operation unit 24 calculates the row vector $H'(g_t^{-1}, \omega)$ and supplies the row vector $H'(g_t^{-1}, \omega)$ to the rotation coefficient holding unit 25 and the head-related transfer function synthesis unit 27.

Herein, the row vector $H'(g_t^{-1}, \omega)$ is a row vector obtained by performing a rotation operation that causes the head-related transfer function in the spherical harmonic domain, that is, the row vector $H_s(\omega)$ to be rotated by the angle $g_t$ on the basis of the rotation matrix $R'(g_t)$ at the time t.

Actually, the rotation operation unit 24 calculates the row vector $H'(g_t^{-1}, \omega)$ at the time t on the basis of the rotation matrix $R'(\Delta g_t)$ supplied from the rotation matrix operation unit 23 and a row vector $H'(g_{t-1}^{-1}, \omega)$ at the time (t−1) supplied from the rotation coefficient holding unit 25.

Such an operation is a rotation operation in which an operation result of a rotation operation at the time (t−1) is further rotated by an angle indicated by the difference $\Delta g_t$. The operation result is the rotated head-related transfer function obtained by a rotation operation that causes the row vector $H_s(\omega)$ to be rotated by the angle $g_{t-1}$.

Further, the rotation operation on the basis of the rotation matrix $R'(\Delta g_t)$ is a matrix operation in which only elements having the order k within a range determined by the predetermined value C in the rotation matrix $R'(\Delta g_t)$ are calculated, that is, an operation limited by the order k is performed. Accordingly, it can be said that the rotation matrix $R'(\Delta g_t)$ is a rotation matrix in which only elements having the order k within the range determined by the predetermined value C are elements having a non-zero effective value, that is, a rotation limited by the order k It is to be noted that the rotation operation unit 24 calculates the row vector $H'(g_t^{-1}, \omega)$ on the basis of the row vector $H_s(\omega)$ of the head-related transfer function supplied from the head-related transfer function holding unit 26 and the rotation matrix $R'(\Delta g_t)$ supplied from the rotation matrix operation unit 23 at the start of processing, that is, in the absence of the row vector $H'(g_{t-1}^{-1}, \omega)$. In this case, the angle $g_{t-1}$ is 0 degrees; therefore, the rotation matrix $R'(\Delta g_t)$ is equivalent to the rotation matrix $R'(g_t)$.

The rotation coefficient holding unit 25 holds the row vector $H'(gt^{-1}, \omega)$ at the time t supplied from the rotation operation unit 24, and supplies the row vector $H'(gt^{-1}, \omega)$ held at a subsequent time (t+1) to the rotation operation unit 24.

The head-related transfer function holding unit 26 holds the predetermined row vector $H_s(\omega)$ or the row vector $H_s(\omega)$ supplied from outside, and supplies the held row vector $H_s(\omega)$ to the rotation operation unit 24. It is to be noted that the row vector $H_s(\omega)$ may be prepared for each listener (user), or the common row vector $H_s(\omega)$ may be prepared for all listeners or a plurality of listeners included in one group.

Herein, the row vector $H'(g^{-1}, \omega)$ is a matrix obtained by rotating the row vector $H_s(\omega)$ including the head-related transfer function in the spherical harmonic domain by the rotation matrix $W(g^{-1})$, that is, a matrix including the head-related transfer function after rotation. In other words, the row vector $H'(g^{-1}, \omega)$ is a matrix (vector) including, as an element, a head-related transfer function rotated by angles determined by the direction of the head of the listener in the spherical harmonic domain, that is, by the angle $\phi$ in the horizontal direction, the angle $\theta$ in the elevation angle direction, and the angle $\psi$ in the horizontal direction.

It is to be noted that, herein, description has been given of an example in which the head-related transfer function is rotated in all directions of the angle $\theta$, the angle $\phi$, and the angle $\psi$ by a difference between rotation at the time t and rotation at the time (t−1) with use of the row vector $H'(g_{t-1}^{-1}, \omega)$ that is an operation result at the time (t−1). However, this is not limitative, and a result of the rotation operation of the head-related transfer function at the time (t−1) may be further rotated in a direction (a rotation direction) of at least one of the angle $\theta$, the angle $\phi$, or the angle $\psi$ by a difference between the angle at the time t and the angle at the time (t−1).

The head-related transfer function synthesis unit 27 synthesizes the input signal $D'_n{}^m(\omega)$ for each of the time frequency bins w supplied from outside and the row vector $H'(g_t^{-1}, \omega)$ supplied from the rotation operation unit 24 to generate the drive signals of the left and right headphones. The input signal $D'_n{}^m(\omega)$ is a sound signal of the spherical harmonic domain.

That is, the head-related transfer function synthesis unit 27 calculates the drive signal $P_l(g, \omega)$ and the drive signal $P_r(g, \omega)$ of the left and right headphones by determining the product of the row vector $H'(g_t^{-1}, \omega)$ and the matrix $D'(\omega)$ including the input signal $D'_n{}^m(\omega)$ for each of the left and right headphones, and supplies the drive signal $P_l(g, \omega)$ and the drive signal $P_r(g, \omega)$ to the time frequency inverse transformation unit 28. The input signal $D'_n{}^m(\omega)$ is the sound signal of the spherical harmonic domain.

Herein, the drive signal $P_l(g, \omega)$ is a drive signal (binaural signal) of the left headphone in the time frequency domain and the drive signal $P_r(g, \omega)$ is a drive signal (binaural signal) of the right headphone in the time frequency domain.

In the head-related transfer function synthesis unit 27, synthesis of the head-related transfer function on the input signal and spherical harmonic inverse transformation on the input signal are performed simultaneously.

The time frequency inverse transformation unit 28 performs time frequency inverse transformation on the drive signals in the time frequency domain supplied from the head-related transfer function synthesis unit 27 for the respective left and right headphones to determine the drive signal $p_l(g, t)$ of the left headphone in the time domain and the drive signal $p_r(g, t)$ of the right headphone in the time domain, and outputs these drive signals to a subsequent stage. In a reproduction device that reproduces sound by two channels or a plurality of channels, such as headphones in the subsequent stage, more specifically, headphones including earphones and speakers using transaural technology, sound is reproduced on the basis of the drive signals outputted from the time frequency inverse transformation unit 28. It is to be noted that, in a case where a signal to be inputted is not subjected to time frequency transformation, a time frequency transformation unit is provided in an signal input portion, that is, in a previous stage of the head-related transfer function synthesis unit 27, for example, or a convolution operation in the time domain is performed in the head-related transfer function synthesis unit 27.

Herein, processing in the respective components of the audio processor 11 is described in detail.

For example, the rotation matrix operation unit 23 determines the head rotational information at the time t, that is, the difference $\Delta g_t = g_t g_{t-1}^{-1}$ between the angle $g_t$ at the time t and the angle $g_{t-1}$ at the time (t−1). Then, the rotation matrix operation unit 23 determines the difference $\Delta\theta_t$, the difference $\Delta\phi_t$, and the difference $\Delta\psi_t$ from the difference $\Delta g_t$, reads, from the tables of the held rotation matrix $R'(a(\theta))$ and the held rotation matrix $R'(u(\phi))$, the rotation matrix $R'(a(\theta))$ in a case where the angle $\theta$ is the difference $\Delta\theta_t$, and the rotation matrix $R'(u(\phi))$ in a case where the angle $\phi$ is the difference $\Delta\phi_t$ and the difference $\Delta\psi_t$, and sets the rotation matrices as the rotation matrix $R'(a(\Delta\theta_t))$, the rotation matrix $R'(u(\Delta\phi_t))$, and the rotation matrix $R(u(\Delta\psi_t))$.

Further, the rotation matrix operation unit 23 performs an operation similar to the expression (29) described above, and synthesizes the thus-obtained rotation matrix $R'(a(\Delta\theta_t))$, the thus-obtained rotation matrix $R'(u(\Delta\phi_t))$, and the thus-obtained rotation matrix $R(u(\Delta\psi_t))$ to obtain the rotation matrix $R'(\Delta g_t)$.

Figure 12:
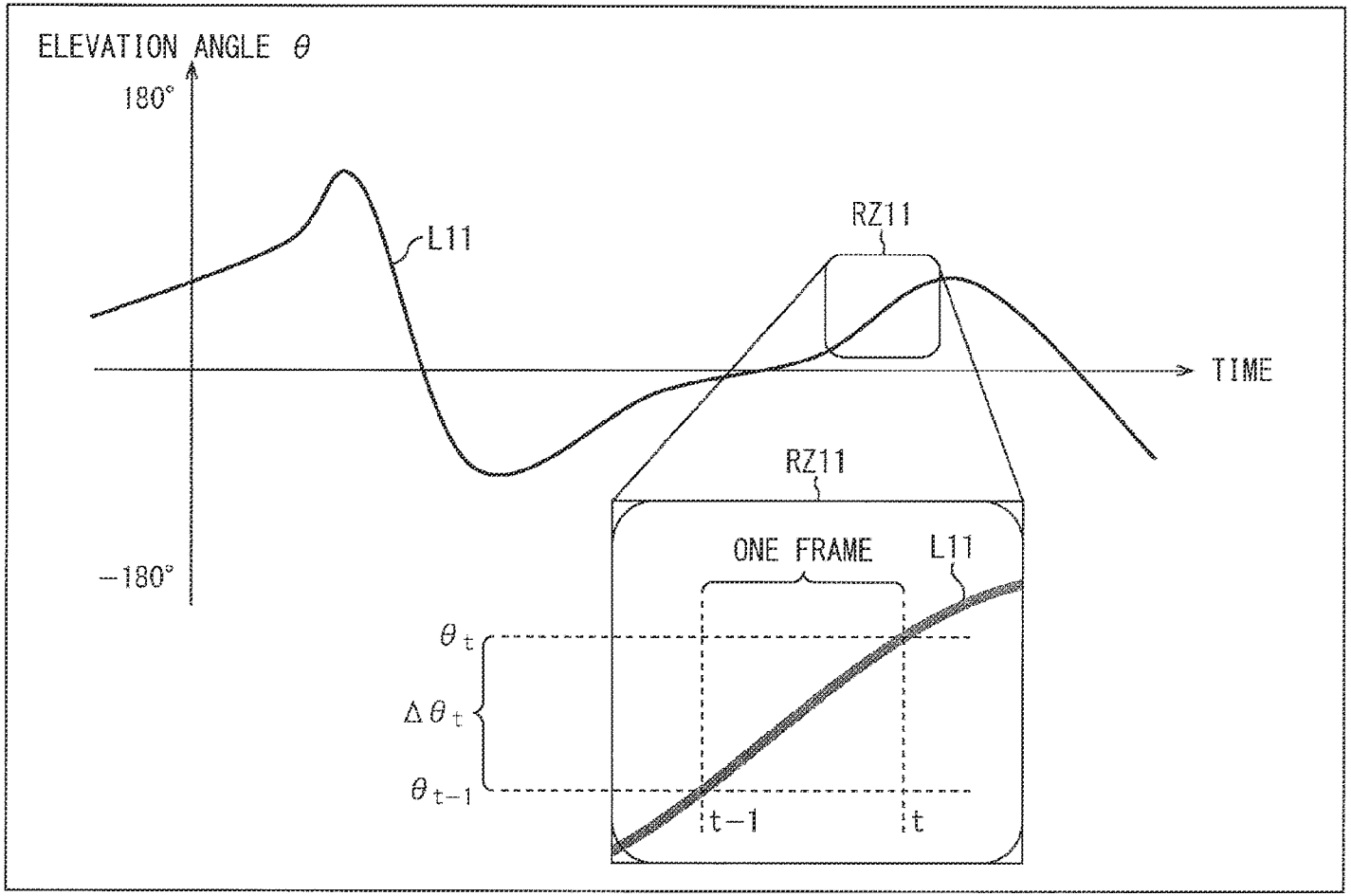
FIG. 12 is a diagram describing a difference in an elevation angle direction.

For example, in a case where the difference $\Delta\theta_t$ is determined for each frame, that is, every frame of the input signal $D'_n{}^m(\omega)$, the difference $\Delta\theta_t$ is as illustrated in FIG. 12. It is to be noted that, in FIG. 12, a vertical axis represents the angle $\theta$ (elevation angle $\theta$) at each time, and a horizontal axis represents time.

In an example illustrated in FIG. 12, a curve L11 represents the angles $\theta$ at respective times, and an enlarged portion of a region RZ11 in the curve L11 is as illustrated in a portion on a lower side of the diagram.

Herein, a period from the time t−1 to the time t is a period of one frame. Accordingly, a difference between the angle $\theta_t$ and the angle $\theta_{t-1}$ is $\Delta\theta_t$. The angle $\theta_t$ is the angle $\theta$ at the time t, and the angle $\theta_{t-1}$ is the angle $\theta$ at the time t−1.

In the rotation matrix operation unit 23, the rotation matrix $R'(\Delta g_t)$ obtained on the basis of the difference $\Delta g_t$ is supplied to the rotation operation unit 24, and the angle $g_t$ at the time t is supplied to the previous direction holding unit 22 to update the previous direction information. That is, the newly supplied angle $g_t$ at the time t is held as the updated previous direction information.

In the rotation operation unit 24, the row vector $H'(g_t^{-1}, \omega)$ at the time t is calculated on the basis of the rotation matrix $R'(\Delta g_t)$ and the row vector $H'(g_{t-1}^{-1}, \omega)$ at the time (t−1).

For example, the following expression (39) is established for an optional rotation matrix $g_1$ and an optional rotation matrix $g_2$.

[Math. 39]

$$R'(g_1 g_2) = R'(g_1) R'(g_2) \tag{39}$$

It can be seen from this that the following expression (40) is established, and the row vector $H'(g_t^{-1}, \omega)$ is determined by determining the product of the row vector $H'(g_{t-1}^{-1}, \omega)$ and the rotation matrix $R'(\Delta g_t)$.

[Math. 40]

$$H'(g_t^{-1}, \omega) = H'(g_{t-1}^{-1}, \omega) R'(\Delta g_t) \tag{40}$$

That is, it is assumed that elements of the degree n and the order k in the row vector $H'(g_t^{-1}, \omega)$ represents $H'_n{}^m(g_t^{-1}, \omega)$, elements of the degree n and the order m in the rotation matrix $R'(\Delta g_t)$ represents $R'^{(n)}_{k,m}(\Delta g_t)$, and a constant that determines the effective element width for the degree n of the rotation matrix $R'(\Delta g_t)$ represents C. In this case, the following expression (41) is established. That is, it is possible to determine respective non-zero elements of the row vector $H'(g_t^{-1}, \omega)$ by an operation of the following expression (41).

[Math. 41]

$$H'^m_n(g_t^{-1}, \omega) = \sum_{k=-n}^{n} H_n^{rk}(g_{t-1}^{-1}, \omega) R'^{(n)}_{k,m}(\Delta g_t) \cong \sum_{k=max(-n,m-C)}^{min(n,m+C)} H_n^{rk}(g_{t-1}^{-1}, \omega) R'^{(n)}_{k,m}(\Delta g_t) \tag{41}$$

The rotation operation unit 24 obtains the row vector $H'(g_t^{-1}, \omega)$ by calculating the expression (41). In the calculation of the expression (41), only (2C+1) elements having the order k ranging from m−C to m+C, where m is set as a center, are calculated similarly to the expression (36) described above. Note that the order k is limited to a range of $-n \le k \le n$. That is, the operation is performed only on elements in which the order k has a value within a range determined by C, which is the operation in which the order k is limited, and the operation amount is reduced.

It is to be noted that, in the rotation matrix operation unit 23, the rotation matrix $R'(a(\Delta\theta_t))$ may be sequentially determined by calculation, or the rotation matrix $R'(a(\Delta\theta_t))$ may be selected from one or a plurality of candidates prepared in advance.

Further, a method of performing an operation on the rotation matrix $R'(a(\Delta\theta_t))$ by the time and a method of selecting the rotation matrix $R'(a(\Delta\theta_t))$ from one or a plurality of candidates may be combined, and an angle by which the head-related transfer function is rotated by tracking the actual angle $\theta_t$ of rotation of the head of the listener may be adjusted while changing frequency of using these respective methods.

<Description of Drive signal Generation Processing>

Figure 13:
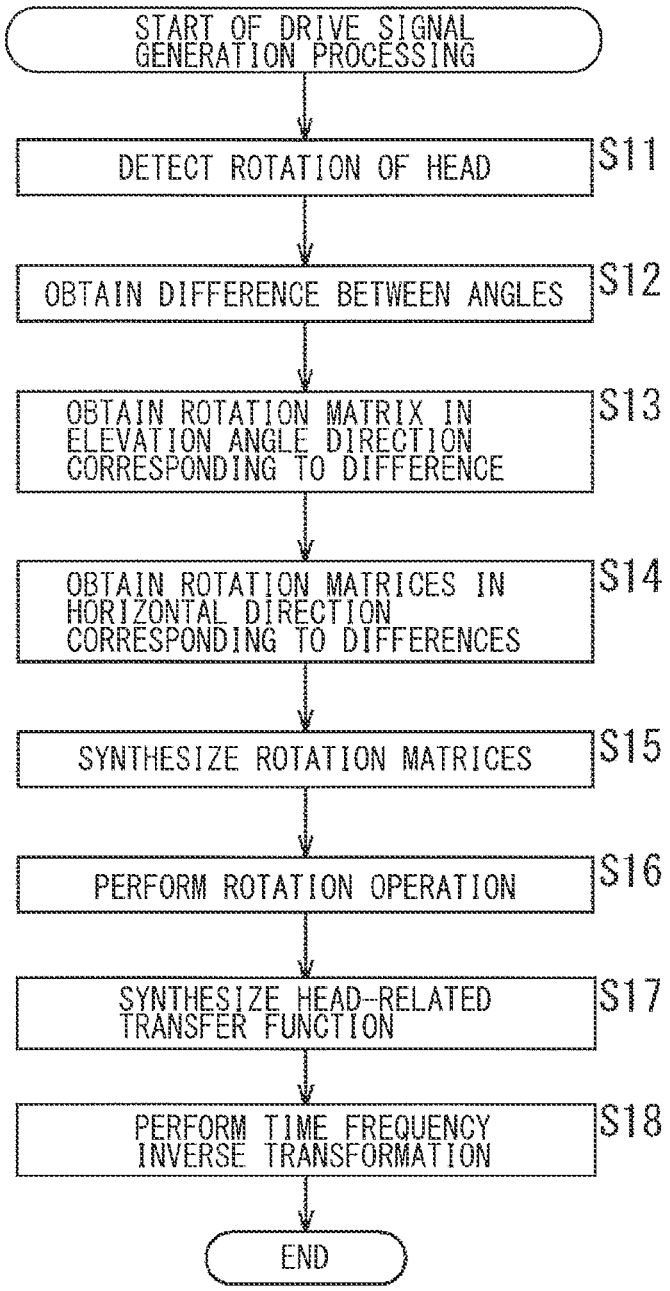
FIG. 13 is a flow chart describing drive signal generation processing.

Next, description is given of drive signal generation processing performed by the audio processor 11 with reference to a flow chart of FIG. 13.

In step S11, the head rotation sensor unit 21 detects rotation of the head of the user who is the listener, and supplies head rotation information obtained as a result of the detection to the rotation matrix operation unit 23.

In step S12, the rotation matrix operation unit 23 determines the difference $\Delta g_t$ between the angle $g_t$ of the head rotational information supplied from the head rotation sensor unit 21 and the angle $g_{t-1}$ at the time (t−1) held as the previous direction information in the previous direction holding unit 22.

In addition, upon obtaining the difference $\Delta g_t$, the rotation matrix operation unit 23 supplies the angle $g_t$ of the head rotational information obtained in the step S11 to the previous direction holding unit 22 to update the previous direction information. The previous direction holding unit 22 updates the previous direction information to cause the angle $g_t$ supplied from the rotation matrix operation unit 23 to become new previous direction information, and holds a thus-updated result.

In step S13, on the basis of the difference $\Delta g_t$ obtained in the step S12, the rotation matrix operation unit 23 determines the rotation matrix $R'(a(\Delta\theta_t))$ in the elevation angle direction corresponding to the difference $\Delta\theta_t$ of the difference $\Delta g_t$. It is to be noted that, in the step S13, the rotation matrix operation unit 23 may determine, as the rotation matrix $R'(a(\Delta\theta_t))$, the rotation matrix $Rs'(a(\Delta\theta_t))$ corresponding to the difference $\Delta\theta_t$. The rotation matrix $Rs'(a(\Delta\theta_t))$ corresponds to the rotation matrix $Rs'(a(\theta))$.

In step S14, on the basis of the difference $\Delta\phi_t$ and the difference $\Delta\psi_t$ in rotation of the head determined from the difference $\Delta g_t$ that is obtained in the step S12, the rotation matrix operation unit 23 determines the rotation matrix $R'(u(\Delta\phi_t))$ and the rotation matrix $R'(u(\Delta\psi_t))$ in the horizontal direction corresponding to the differences $\Delta\phi_t$ and $\Delta\psi_t$.

In step S15, the rotation matrix operation unit 23 synthesizes the rotation matrix $R'(a(\Delta\theta_t))$ in the elevation angle direction obtained in the step S13 and the rotation matrix $R'(u(\Delta\phi_t))$ and the rotation matrix $R'(u(\Delta\psi_t))$ in the horizontal direction obtained in the step S14 to determine the rotation matrix $R'(\Delta g_t)$ for performing rotation by a difference in rotation of the entire head, and supplies the rotation matrix $R'(\Delta g_t)$ to the rotation operation unit 24.

In step S16, the rotation operation unit 24 performs a rotation operation on the basis of the rotation matrix $R'(\Delta g_t)$ supplied from the rotation matrix operation unit 23 and the row vector $H'(g_{t-1}^{-1}, \omega)$ held in the rotation coefficient holding unit 25.

That is, for example, in the step S16, the expression (41) described above is calculated as a rotation operation on the basis of the effective element width 2C+1 determined by the constant C to calculate the row vector $H'(g_t^{-1}, \omega)$.

The rotation operation unit 24 supplies the obtained row vector $H'(g_t^{-1}, \omega)$ to the rotation coefficient holding unit 25, and causes the rotation coefficient holding unit 25 to hold the row vector $H'(g_t^{-1}, \omega)$, and also supplies the row vector $H'(g_t^{-1}, \omega)$ to the head-related transfer function synthesis unit 27.

In step S17, the head-related transfer function synthesis unit 27 synthesizes the supplied input signal $D'_n{}^m(\omega)$ and the row vector $H'(g_t^{-1}, \omega)$ of the head-related transfer function supplied from the rotation operation unit 24 to generate drive signals of the left and right headphones.

For example, in the step S17, the product of the row vector $H'(g_t^{-1}, \omega)$ and the matrix $D'(\omega)$ is determined for each of the left and right headphones to calculate the drive signal $P_l(g, \omega)$ and the drive signal $P_r(g, \omega)$ of the left and right headphones. The head-related transfer function synthesis unit 27 supplies the obtained drive signal $P_l(g, \omega)$ and the obtained drive signal $P_r(g, \omega)$ to the time frequency inverse transformation unit 28.

In step S18, the time frequency inverse transformation unit 28 performs time frequency inverse transformation on the drive signal $P_l(g, \omega)$ and the drive signal $P_r(g, \omega)$ supplied from the head-related transfer function synthesis unit 27, and outputs, to a subsequent stage, the drive signal $P_l(g, t)$ and the drive signal $P_r(g, t)$ that are obtained as results of the time frequency inverse transformation, and the drive signal generation processing ends.

As described above, the audio processor 11 determines the rotation matrix $R'(\Delta g_t)$ on the basis of the difference $\Delta g_t$, and determines the current row vector $H'(g_t^{-1}, \omega)$ on the basis of the rotation matrix $R'(\Delta g_t)$ and the previous row vector $H'(g_{t-1}^{-1}, \omega)$.

Thus, rotations by the difference $\Delta g_t$, which is a minute rotation angle, are accumulated to determine the row vector $H'(g_t^{-1}, \omega)$, which makes it possible to reduce the memory amount and the operation amount that are to be used. This makes it possible to reproduce sound more efficiently. Specifically, according to the proposed technique 1 described above, it is possible to obtain the drive signals with a memory amount substantially equal to that in the fourth technique and with a smaller operation amount than that in the fourth technique.

Second Embodiment

<Configuration Example of Audio Processor>

Incidentally, in the proposed technique 1 described above, only the elements in the block having the effective element width 2C+1 determined by the constant C, that is, only the effective elements are used to perform the operation, resulting in not a few errors in the rotation matrix $R'(g_t)$, that is, in the row vector $H'(g_t^{-1}, \omega)$.

In addition, in a case where the operation causing such an error is repeatedly performed for a while, the errors are accumulated, thereby causing the row vector $H'(g_t^{-1}, \omega)$ to become a value different from an original value. That is, the error in the row vector $H'(g_t^{-1}, \omega)$ becomes large.

Accordingly, accumulation of errors may be prevented by performing an operation of determining an accurate rotation matrix $R'(g_t^{-1})$ at a predetermined timing and resetting the value of the rotation matrix $R'(g_t^{-1})$, that is, the row vector $H'(g_t^{-1}, \omega)$ (hereinafter, simply referred to as resetting). Hereinafter, a technique of performing resetting at a predetermined timing in the proposed technique 1 is also referred to as proposed technique 2.

In the proposed technique 2, an operation of an operation amount of a cube order of the degree n is necessary to determine the row vector $H'(g_t^{-1}, \omega)$ at the time of resetting, but performing the resetting less frequently makes it possible to reduce the operation amount as a whole.

Figure 14:
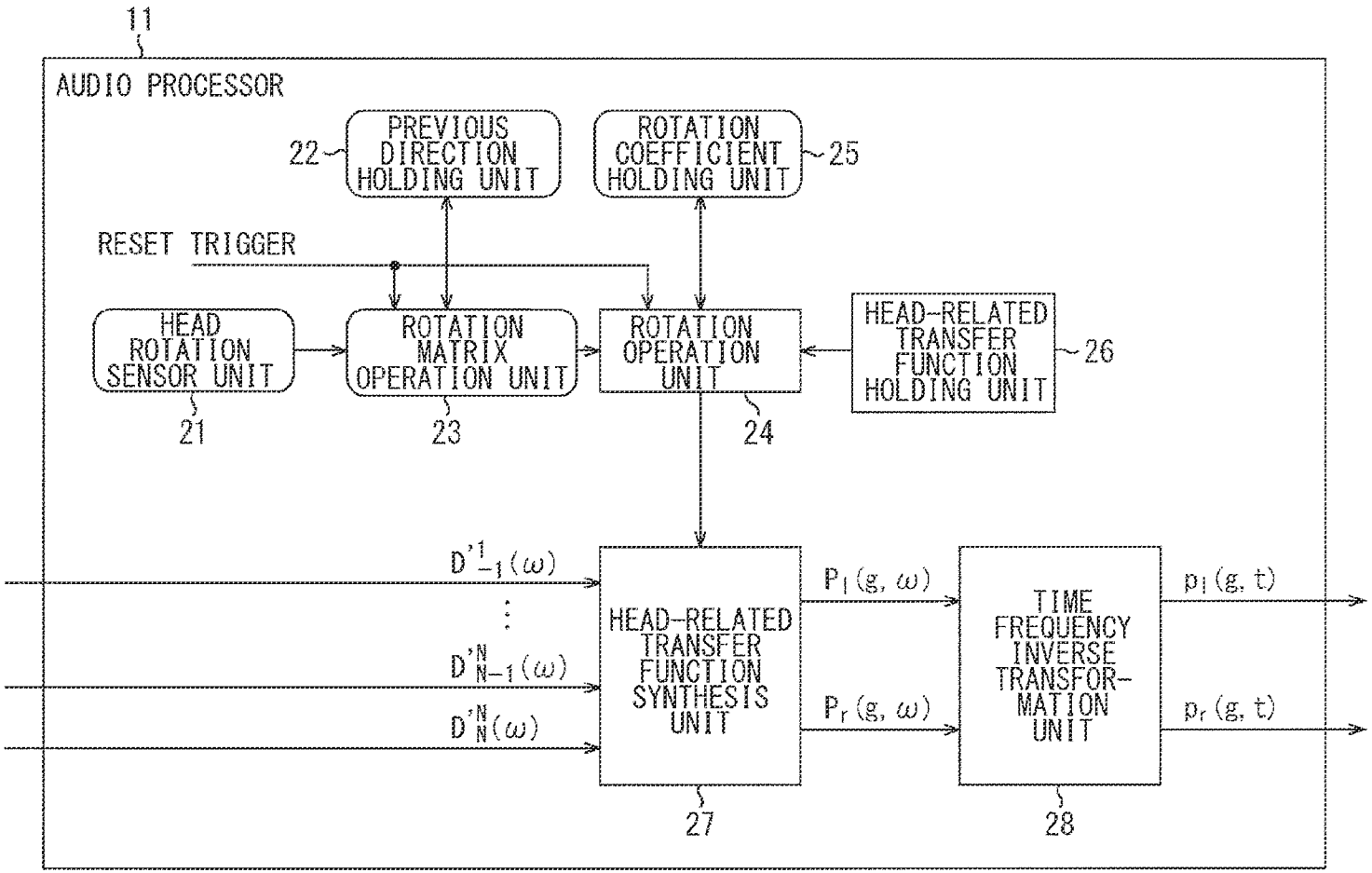
FIG. 14 is a diagram illustrating a configuration example of an audio processor.

In a case where the resetting is performed appropriately in such a manner, the audio processor 11 is configured as illustrated in FIG. 14. It is to be noted that, in FIG. 14, components corresponding to those in FIG. 11 are denoted by the same reference numerals, and description thereof is omitted as appropriate.

The audio processor 11 illustrated in FIG. 14 includes the head rotation sensor unit 21, the previous direction holding unit 22, the rotation matrix operation unit 23, the rotation operation unit 24, the rotation coefficient holding unit 25, the head-related transfer function holding unit 26, the head-related transfer function synthesis unit 27, and the time frequency inverse transformation unit 28.

The audio processor 11 illustrated in FIG. 14 is the same as the audio processor 11 in FIG. 11 in including components from the head rotation sensor unit 21 to the time frequency inverse transformation unit 28, but differs from the audio processor 11 in FIG. 11 in that a reset trigger that is a signal indicating a timing of the resetting is supplied to the rotation matrix operation unit 23 and the rotation operation unit 24.

In a case where the reset trigger is not supplied, that is, in a case where the reset trigger is off, the rotation matrix operation unit 23 determines the rotation matrix $R(\Delta g_t)$ on the basis of the angle $g_t$ of the head rotational information and the angle $g_{t-1}$ as the previous direction information, and supplies the rotation matrix $R(\Delta g_t)$ to the rotation operation unit 24.

In contrast, in a case where the reset trigger is supplied, that is, in a case where the reset trigger is on, the rotation matrix operation unit 23 determines the rotation matrix $R'(g_t)$ on the basis of the angle $g_t$ of the head rotation information and supplies the rotation matrix $R'(g_t)$ to the rotation operation unit 24. That is, the resetting is performed to determine the accurate rotation matrix $R'(g_t)$. In other words, a rotation matrix determined by a difference such as rotation matrix $R'(\Delta g_t)$ is not determined, but the absolute the rotation matrix $R'(g_t)$ is determined.

In addition, in the case where the reset trigger is off, the rotation operation unit 24 calculates the row vector $H'(g_t^{-1}, \omega)$ on the basis of the rotation matrix $R'(\Delta g_t)$ supplied from the rotation matrix operation unit 23 and the row vector $H'(g_{t-1}^{-1}, \omega)$ held in the rotation coefficient holding unit 25.

In contrast, in the case where the reset trigger is on, the rotation operation unit 24 calculates the row vector $H'(g_t^{-1}, \omega)$ on the basis of the rotation matrix $R'(g_t)$ supplied from the rotation matrix operation unit 23 and the row vector $H_s(\omega)$ of the head-related transfer function held in the head-related transfer function holding unit 26.

In this case, in the rotation operation unit 24, the row vector $H'(g_t^{-1}, \omega)$ is calculated by performing calculation similar to that in the expression (35) or the expression (36) described above. That is, the product of the rotation matrix $R'(g_t)$ and the row vector $H_s(\omega)$ is determined to calculate the row vector $H'(g_t^{-1}, \omega)$.

In such a manner, the resetting is performed in response to input of the reset trigger to determine the accurate rotation matrix $R'(g_t)$ and the row vector $H'(g_t^{-1}, \omega)$, which makes it possible to obtain a drive signal having a small error while keeping the necessary memory amount the necessary operation amount low.

It is to be noted that, herein, description is given of an example in which the reset trigger is turned on or off at an optional timing, but the reset trigger may be turned on at all time. That is, the rotation matrix $R'(g_t)$ may be calculated at all times.

In addition, the reset trigger may be turned on at any timing. For example, the timing at which the reset trigger is turned on may be a predetermined regular (periodic) timing such as a predetermined time interval, a timing at which the difference $\Delta\theta_t$ becomes equal to or greater than a threshold value, or a timing at which the angle $\theta_t$ becomes equal to or greater than a predetermined value.

<Description of Drive Signal Generation Processing>

Figure 15:
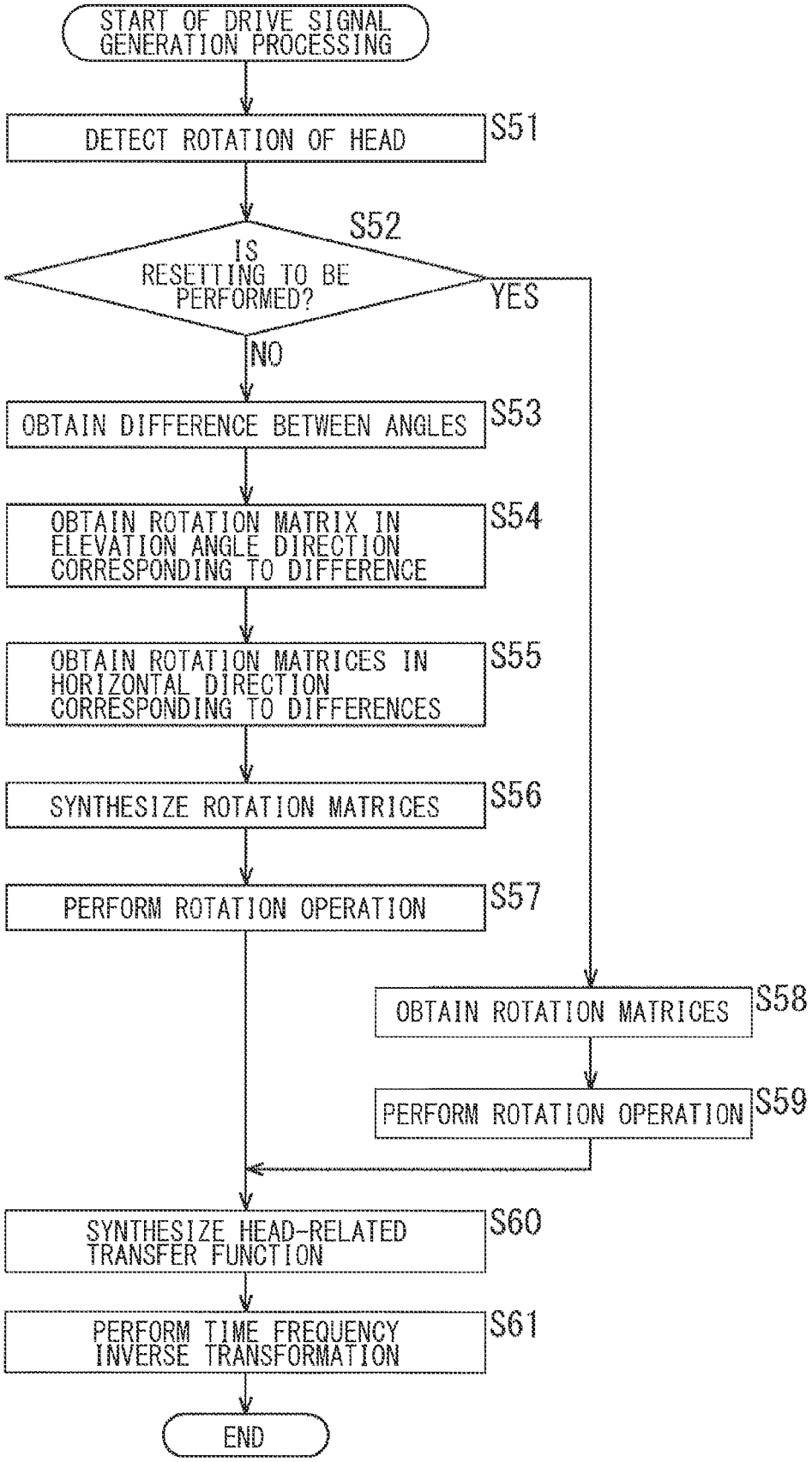
FIG. 15 is a flow chart describing drive signal generation processing.

Next, description is given of drive signal generation processing to be performed by the audio processor 11 in FIG. 14 with reference to a flow chart in FIG. 15.

It is to be noted that a process in step S51 is the same as that in the step S11 in FIG. 13, and the description thereof is omitted.

In step S52, the rotation matrix operation unit 23 determines whether or not to perform the resetting on the basis of the reset trigger supplied from outside. For example, in a case where the reset trigger is turned on, it is determined to perform resetting.

In a case where it is determined not to perform the resetting in the step S52, the processing proceeds to step S53, and processes in steps S53 to S57 are performed.

It is to be noted that the processes in the steps S53 to S57 are the same as those in the steps S12 to S16 in FIG. 13, and the description thereof is omitted.

The process in the step S57 is performed, and then the rotation operation unit 24 supplies the obtained row vector $H'(g_t^{-1}, \omega)$ to the head-related transfer function synthesis unit 27 and the rotation coefficient holding unit 25, and thereafter, the processing proceeds to step S60.

In contrast, in a case where it is determined to perform the resetting in the step S52, in step S58, the rotation matrix operation unit 23 determines the rotation matrix $R'(a(\theta_t))$ in the elevation angle direction, and the rotation matrix $R'(u(\phi_t))$ and the rotation matrix $R'(u(\psi_t))$ in the horizontal direction on the basis of the angle $g_t$ of the head rotation information supplied from the head rotation sensor unit 21.

Further, the rotation matrix operation unit 23 synthesizes the rotation matrix $R'(a(\theta_t))$, the rotation matrix $R'(u(\phi_t))$, and the rotation matrix $R'(u(\psi_t))$ to determine the rotation matrix $R'(g_t)$, and supplies the rotation matrix $R'(g_t)$ to the rotation operation unit 24. It is to be noted that, in the step S58, the rotation matrix $R'(a(\theta_t))$ may be obtained from the table on the basis of the angle $\theta_t$, or the rotation matrix $R'(a(\theta_t))$ may be obtained by an operation on the basis of the angle $\theta_t$. Similarly, the rotation matrix $R'(u(\phi_t))$ and the rotation matrix $R'(u(\psi_t))$ may be determined by an operation on the basis of the angle $\phi_t$ and the angle $\psi_t$, or the rotation matrix $R'(u(\phi_t))$ and the rotation matrix $R'(u(\psi_t))$ may be obtained from the table on the basis of the angle $\phi_t$ and the angle $\psi_t$.

In step S59, the rotation operation unit 24 performs a rotation operation on the basis of the rotation matrix $R'(g_t)$ supplied from the rotation matrix operation unit 23 and the row vector $H_s(\omega)$ of the head-related transfer function held in the head-related transfer function holding unit 26 to calculate the row vector $H'(g_t^{-1}, \omega)$. For example, in the step S59, the row vector $H'(g_t^{-1}, \omega)$ is calculated by performing calculation similar to that in the expression (35) or the expression (36) described above.

The row vector $H'(g_t^{-1}, \omega)$ is obtained, and then the rotation operation unit 24 supplies the obtained row vector $H'(g_t^{-1}, \omega)$ to the head-related transfer function synthesis unit 27 and the rotation coefficient holding unit 25, and thereafter, the processing proceeds to step S60.

After the process in the step S57 or the step S59 is performed, processes in step S60 and step S61 are performed, and the drive signal generation processing ends; however, these processes are the same as those in the step S17 and the step S18 in FIG. 13, and the description thereof is omitted.

As described above, in the case where the reset trigger is turned on, the audio processor 11 determines the accurate rotation matrix $R'(g_t)$ and the accurate row vector $H'(g_t^{-1}, \omega)$ to generate the drive signal. Doing so makes it possible to obtain a drive signal having a small error while keeping the necessary memory amount and the necessary operation amount low.

It is to be noted that, for example, in a case where the head of the listener is abruptly and largely rotated to the elevation angle direction, the difference $\Delta\theta_t$ abruptly increases. Accordingly, in a case where the row vector $H'(g_t^{-1}, \omega)$ is intended to be determined by tracking rotation of the head of the listener, if the row vector $H'(g_t^{-1}, \omega)$ is intended to be determined accurately, the operation amount increases, and if the row vector $H'(g_t^{-1}, \omega)$ is intended to be determined with a small operation amount, the error increases.

In such a case, for example, in a case where it is desired to keep the operation amount low, if the actual difference $\Delta\theta_t$ becomes equal to or greater than a predetermined threshold value such as 30 degrees or greater, the value of the difference $\Delta\theta_t$ may be limited to a value equal to or less than one degree regardless of the actual value of the difference $\Delta\theta_t$, and the rotation matrix operation unit 23 may determine the rotation matrix $R'(a(\Delta\theta_t))$.

Doing so makes it possible to keep the operation amount low, though it is not possible to perform tracking perfectly until the actual difference $\Delta\theta_t$ becomes less than the threshold value, thereby causing an error in the rotation matrix $R'(a(\Delta\theta_t))$. It is to be noted that it is possible to perform such processing independently of turning the reset trigger on or off.

Further, for example, in a case where the actual difference $\Delta\theta_t$ becomes equal to or greater than a predetermined threshold value such as 30 degrees or greater, the rotation matrix operation unit 23 may determine the rotation matrix $R'(a(\theta_t))$ only for the elements in the block having the effective element width 2C+1 determined for C, which is used as a predetermined value, that determines the effective element width 2C+1, that is, only for the effective elements. In this case, in the rotation operation unit 24, calculation of the expression (36) is performed only for the effective elements determined for C to determine the row vector $H'(g_t^{-1}, \omega)$.

In this example, the operation amount is increased because of use of the rotation matrix $R'(g_t)$, but only an operation only for the effective elements determined by C that determines the effective element width 2C+1 is sufficient, which makes it possible to keep the operation amount low to some extent while tracking rotation of the head of the listener. It is also possible to perform such processing independently of turning the reset trigger on or off.

Further, for example, in a case where the actual difference $\Delta\theta_t$ becomes equal to or greater than a predetermined threshold value, such as 30 degrees or greater, the rotation matrix $R'(a(\Delta\theta_t))$ is determined, and the row vector $H'(g_t^{-1}, \omega)$ is determined from the rotation matrix $R'(\Delta g_t)$ and the row vector $H'(g_{t-1}^{-1}, \omega)$ determined by the rotation matrix $R'(a(\Delta\theta_t))$, but at this time, the rotation operation unit 24 may temporarily increase C determining the effective element width 2C+1 to a value greater than a normal value. Herein, the value of C may be a constant, or may be determined by the degree n, the difference $\Delta\theta_t$, or the like.

Doing so makes it possible to perform tracking of rotation of the head of the listener, though the operation amount in a case where the row vector $H'(g_t^{-1}, \omega)$ is determined is increased. Even in this case, it is possible to perform processing of changing the value of C independently of turning the reset trigger on or off.

In addition, the resetting may be performed, for example, in a case where the angle $\theta_t$ of the head rotation information becomes a predetermined value (hereinafter, also referred to as reset point).

Specifically, for example, the rotation matrix operation unit 23 holds the rotation matrix $R'(a(\theta))$ determined in advance for the angle $\theta$, which is the reset point, for every reset point or every plurality of reset points. For example, it is assumed that the rotation matrix $R'(a(\theta_1))$ is held in advance for an angle $\theta_1$ determined as the reset point.

In this case, for example, in a case where the angle $\theta_t$ is the angle $\theta_1$, the rotation matrix operation unit 23 determines the rotation matrix $R'(g_t)$ with use of the held rotation matrix $R'(a(\theta_1))$ as the rotation matrix $R'(a(\theta_t))$, and supplies the rotation matrix $R'(g_t)$ to the rotation operation unit 24. By doing so, a memory is necessary to hold the rotation matrix $R'(a(\theta))$ for each reset point, but it is not necessary to perform an operation of the rotation matrix $R'(a(\theta_t))$, which makes it possible to keep the operation amount low while performing the resetting to obtain the accurate rotation matrix $R'(a(\theta_t))$.

Modification Example 1 of Second Embodiment

<About Resetting Control by Plurality of Devices>

Figure 16:
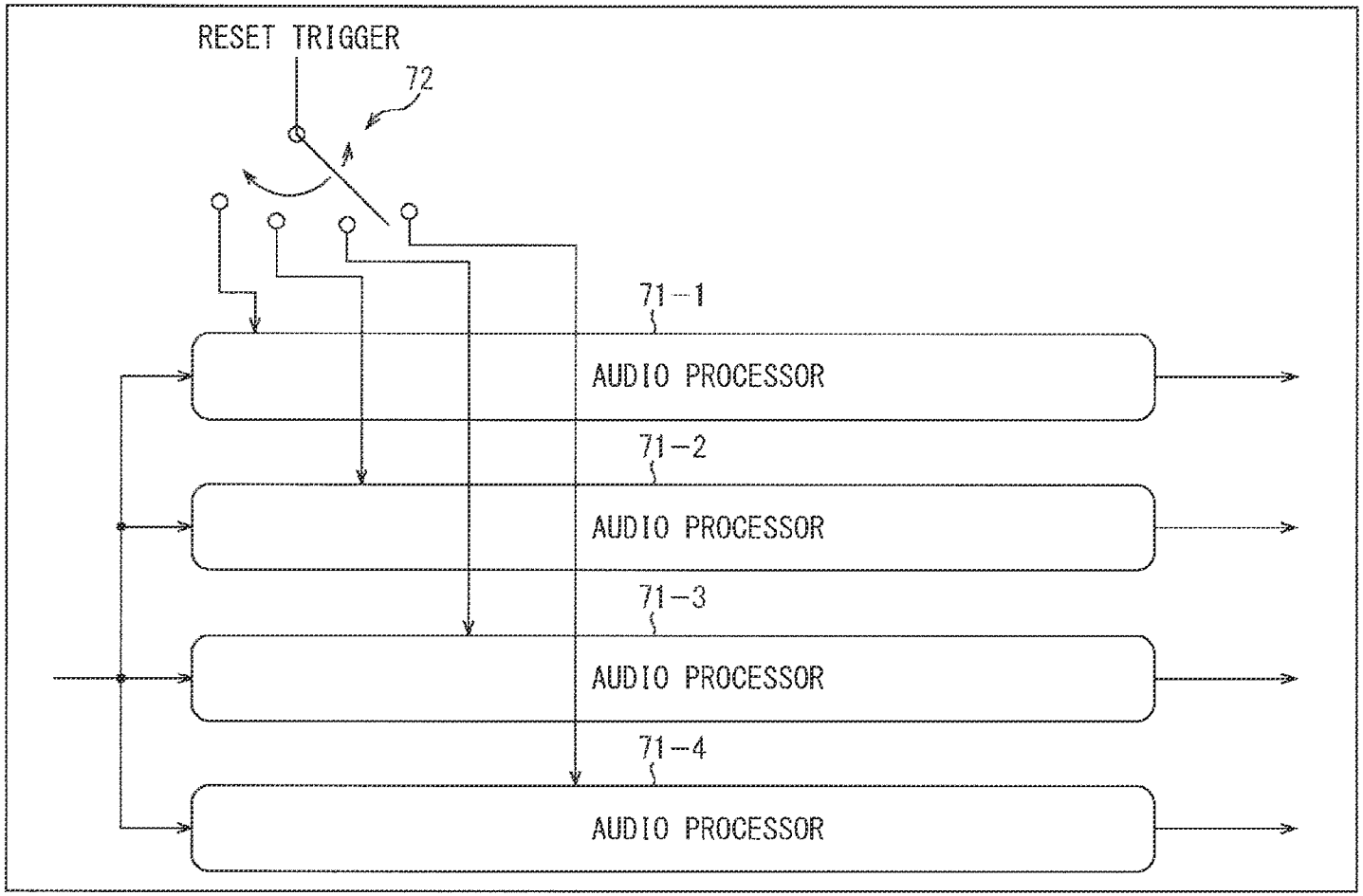
FIG. 16 is a diagram illustrating a configuration example of a control system.

In addition, for example, it is assumed that a plurality of listeners exists in a space, and as illustrated in FIG. 16, there is a control system in which each of a plurality of audio processors outputs a drive signal to each of the headphones and the like worn by each of the listeners.

The control system illustrated in FIG. 16 includes audio processors 71-1 to 71-4 and a switch 72.

Each of the audio processors 71-1 to 71-4 has the same configuration as that of the audio processor 11 illustrated in FIG. 14. Hereinafter, in a case where it is not necessary to particularly distinguish the audio processors 71-1 to 71-4, the audio processors 71-1 to 71-4 are also simply referred to as audio processors 71.

Each of the audio processor 71 receives the input signal $D'_n{}^m(\omega)$, performs processing similar to the drive signal generation processing described with reference to FIG. 15, and outputs the drive signal kg, t) and the drive signal $p_r$(g, t) of the left and right headphones.

It is to be noted that each of the audio processors 71 may be one independent device, or these audio processors 71 may be provided in one device, but it is assumed herein that the respective audio processors 71 are provided in one computing system (device) located in a middle.

The switch 72 controls supply of the reset trigger to the audio processors 71 to supply the reset trigger to one audio processor 71 of the audio processors 71-1 to 71-4 at an optional timing.

In such a control system, each of the plurality of listeners wears headphones, and each of the headphones reproduces sound on the basis of the drive signal supplied from each of the audio processors 71 that are different from each other.

Then, each of the audio processors 71 detects movement (rotation) of the headphones to which the drive signal is to be outputted, that is, movement (rotation) of the head of the listener wearing the headphones in the head rotation sensor unit 21, and rotates the head-related transfer function by tracking the movement of the head of the listener, and generates the drive signal.

In the control system, the reset trigger is supplied to each of the four audio processors 71 by the switch 72 at different timings; therefore, the resetting is not performed simultaneously on the audio processors 71. This makes it possible to suppress a sudden increase in an operation load in the entire control system. That is, it is possible to prevent a temporary increase in the operation amount.

Figure 17:
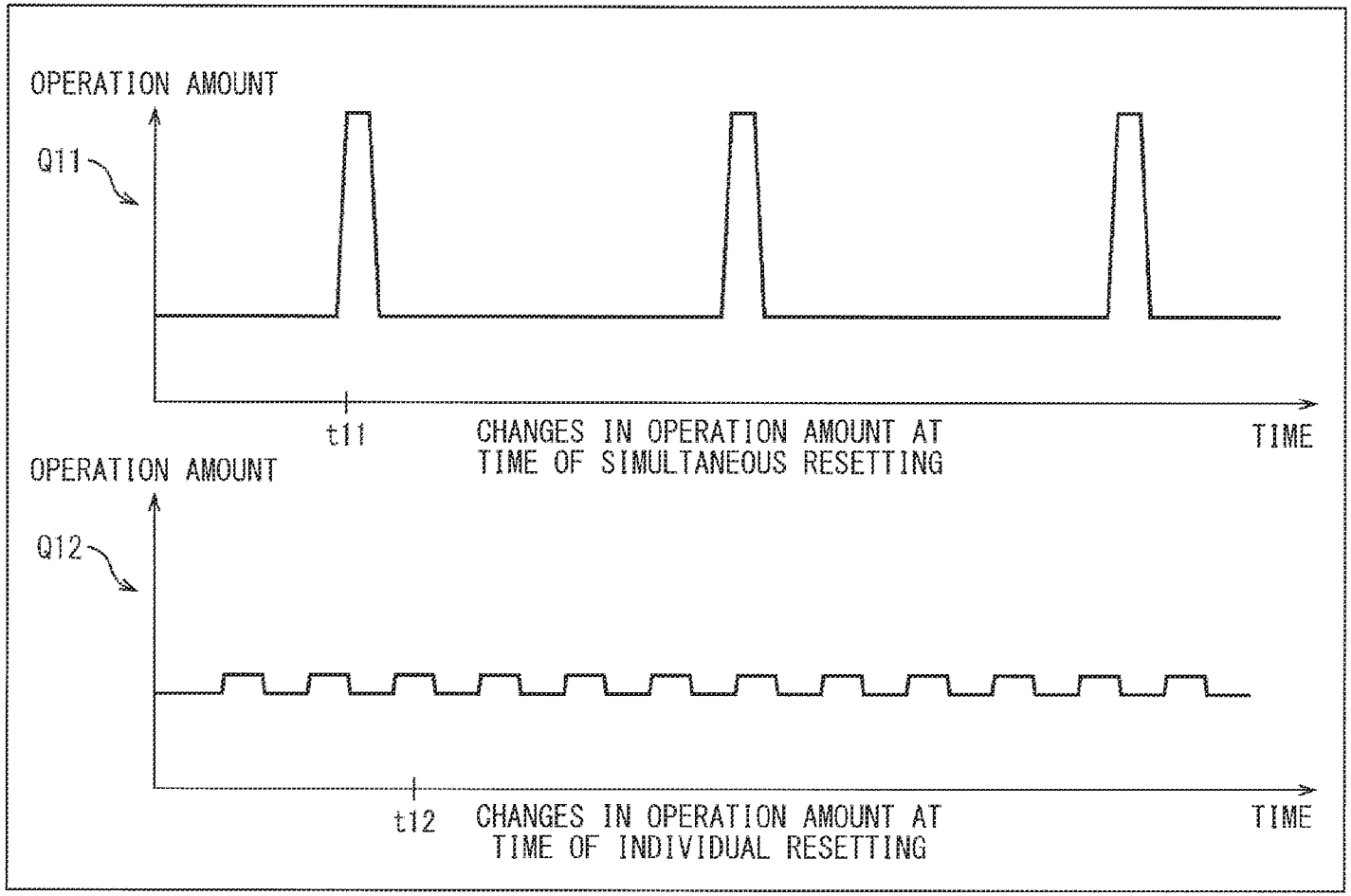
FIG. 17 is a diagram describing resetting and an operation amount.

In the control system, in a case where the resetting is performed simultaneously on four audio processors 71, the operation amount in the entire control system temporarily becomes large (increases) at a time at which the resetting is performed, as indicated by an arrow Q11 in FIG. 17, for example.

It is to be noted that, in FIG. 17, a vertical axis represents the operation amount in the entire control system, and a horizontal axis represents time.

For example, in an example indicated by the arrow Q11, the resetting is performed simultaneously on the four audio processors 71 in the control system at predetermined intervals. For example, the resetting is performed at a time 11, and the operation amount becomes large (increases) at the time t11, but the operation amount is kept low at other times at which the resetting is not performed.

In this case, although the operation amount increases with a low frequency, the operation load on the control system temporarily increases at the time of the resetting.

In contrast, in the example indicated by the arrow Q12, for example, the resetting is not performed simultaneously on the plurality of audio processors 71, but the resetting is performed on the respective audio processors 71 at different timings. The operation amount increases with a higher frequency, but the operation amount at each time does not become so large. That is, although the operation amount rises at the time of the resetting, an increase in the operation amount at that time is only an amount corresponding to the resetting on one audio processor 71; therefore, the operation load to be applied is not as large as the operation load applied in a case where the resetting is performed simultaneously on the plurality of audio processors 71.

For example, at a time t12, the resetting is performed on one audio processor 71, but the operation amount is kept low, as compared with that at the time t11 in the example indicated by the arrow Q11.

It is to be noted that, although description has been given of an example in which the resetting is performed on one audio processor 71 at a time, it is possible to suppress the operation load unless the resetting is performed simultaneously on all the audio processors 71. For example, all the audio processors 71 may be divided into a plurality of groups including one or a plurality of audio processors 71, and the resetting may be performed on each of the groups.

As described above, in a case where there is a plurality of audio processors 71, the resetting is performed on the respective audio processors 71 at timing different from each other, which makes it possible to suppress a temporary increase in the operation amount.

Modification Example 2 of Second Embodiment

<About Resetting for Each Degree or Each Order>

In addition, the resetting may be performed for each degree n or for each order m regardless of the example of the audio processor 11 illustrated in FIG. 14 and the example of the control system illustrated in FIG. 16, that is, regardless of whether one or a plurality of listeners exist. Doing so makes it possible to suppress an increase in the operation load at the time of the resetting.

Figure 18:
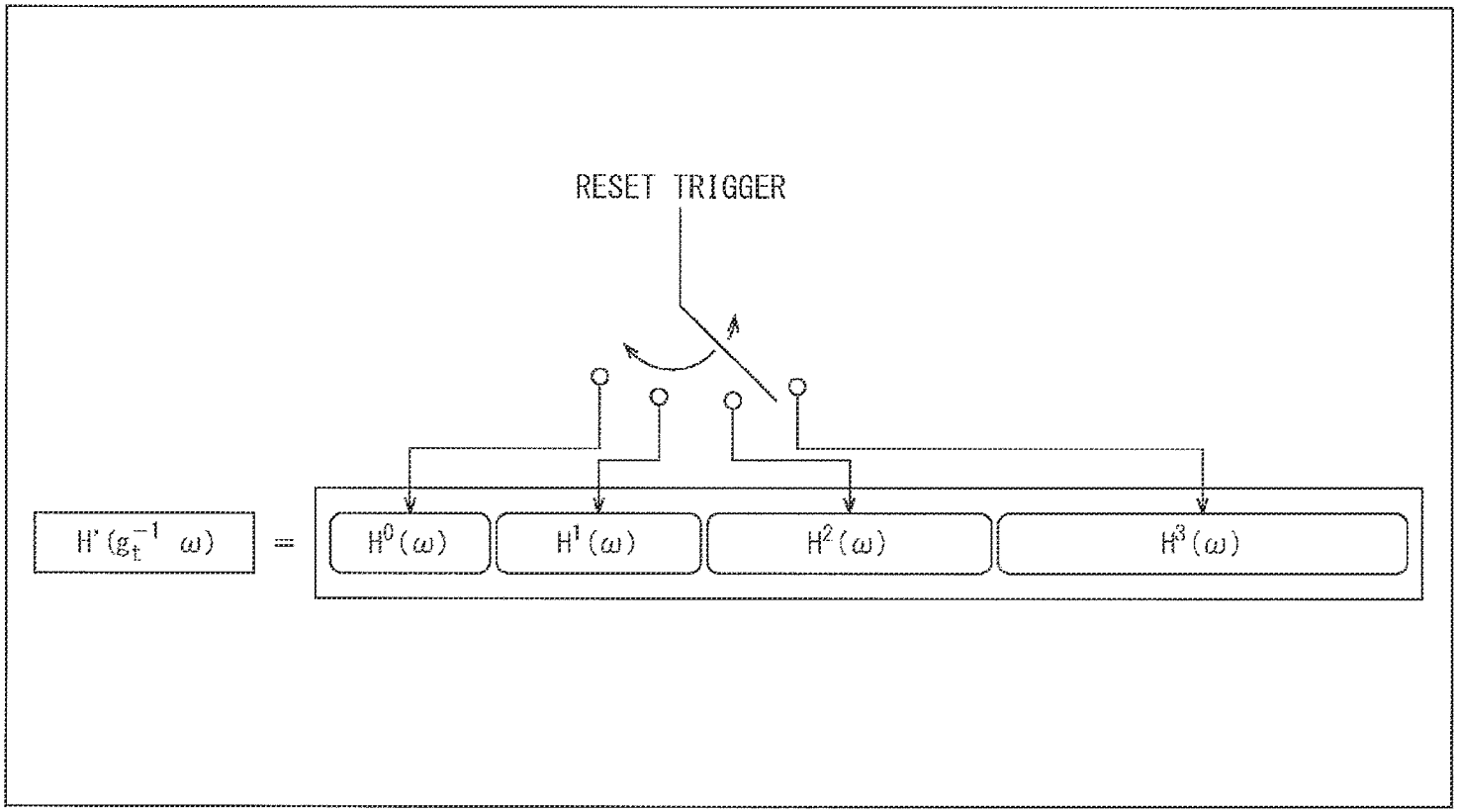
FIG. 18 is a diagram describing resetting for each degree.

For example, as illustrated in FIG. 18, it is assumed that the row vector $H'(g_t^{-1}, \omega)$ includes a matrix $H^0(\omega)$ including elements of the degree n=0, a matrix $H^1(\omega)$ including elements of the degree n=1, a matrix $H^2(\omega)$ including elements of the degree n=2, and a matrix $H^3(\omega)$ including elements of the degree n=3.

In such a case, for example, the resetting may be performed only on a component of a predetermined degree for the degree n. At this time, the resetting may be performed on components of the respective degrees at different timings, or the resetting may be performed simultaneously on components of some of the degrees.

For example, in a case where the resetting is performed only on a zeroth-order component of the degree n, that is, on a component of the degree n=0, the product of the rotation matrix $R'(g_t)$ and the row vector $H_s(\omega)$ for the zeroth-order component is determined to generate the matrix $H^0(\omega)$.

In contrast, for first to third-order components of the degree n, the product of the rotation matrix $R'(\Delta g_t)$ and the row vector $H'(g_{t-1}^{-1}, \omega)$ is determined, that is, calculation of the expression (41) is performed to generate the matrix $H^1(\omega)$, the matrix $H^2(\omega)$, and the matrix $H^3(\omega)$.

Then, the final row vector $H'(g_t^{-1}, \omega)$ is obtained from the matrix $H^0(\omega)$, the matrix $H^1(\omega)$, the matrix $H^2(\omega)$, and the matrix $H^3(\omega)$ that are thus obtained.

Accordingly, for example, in the audio processor 11 illustrated in FIG. 14, at a timing at which the resetting is performed only on the zeroth-order component of the degree n, the process in the step S58 in FIG. 15 and the process in the step S59 in FIG. 15 are performed on the zeroth-order component to generate the matrix $H^0(\omega)$. In contrast, for the first to third-order components of the degree n, the processes in the steps S53 to S57 are performed to generate the matrix $H^1(\omega)$, the matrix $H^2(\omega)$, and the matrix $H^3(\omega)$. Then, the row vector $H'(g_t^{-1}, \omega)$ is generated from the matrix $H^0(\omega)$, the matrix $H^1(\omega)$, the matrix $H^2(\omega)$, and the matrix $H^3(\omega)$.

It is to be noted that, even in a case where the resetting is performed for each degree, for example, some groups such as a group including zeroth and first orders of the degree n may be provided, and the resetting may be performed for each of the group.

For example, in an example illustrated in FIG. 18, the number of elements is small from the zeroth to second orders of the degree n; therefore, the zeroth to second orders of the degree n may be set as one group, and the resetting may be performed simultaneously on the zeroth-order, first-order, and second-order components of the degree n. In this case, a timing at which the resetting is performed on the zeroth-order, first-order, and second-order components of the degree n is different from a timing at which the resetting is performed on the third-order component of the degree n.

It is to be noted that, although description has been given of a case where the resetting is performed for each degree n as a specific example, a case where the resetting is performed for each order m is also the same as the case where the resetting is performed for each degree n.

Modification Example 3 of Second Embodiment

<About Resetting for Each Time Frequency>

In addition, the resetting may be performed for each time frequency ω regardless of the example of the audio processor 11 illustrated in FIG. 14 and the example of the control system illustrated in FIG. 16, that is, regardless of whether one or a plurality of listeners exists. Doing so makes it possible to suppress an increase in the operation load at the time of the resetting.

Figure 19:
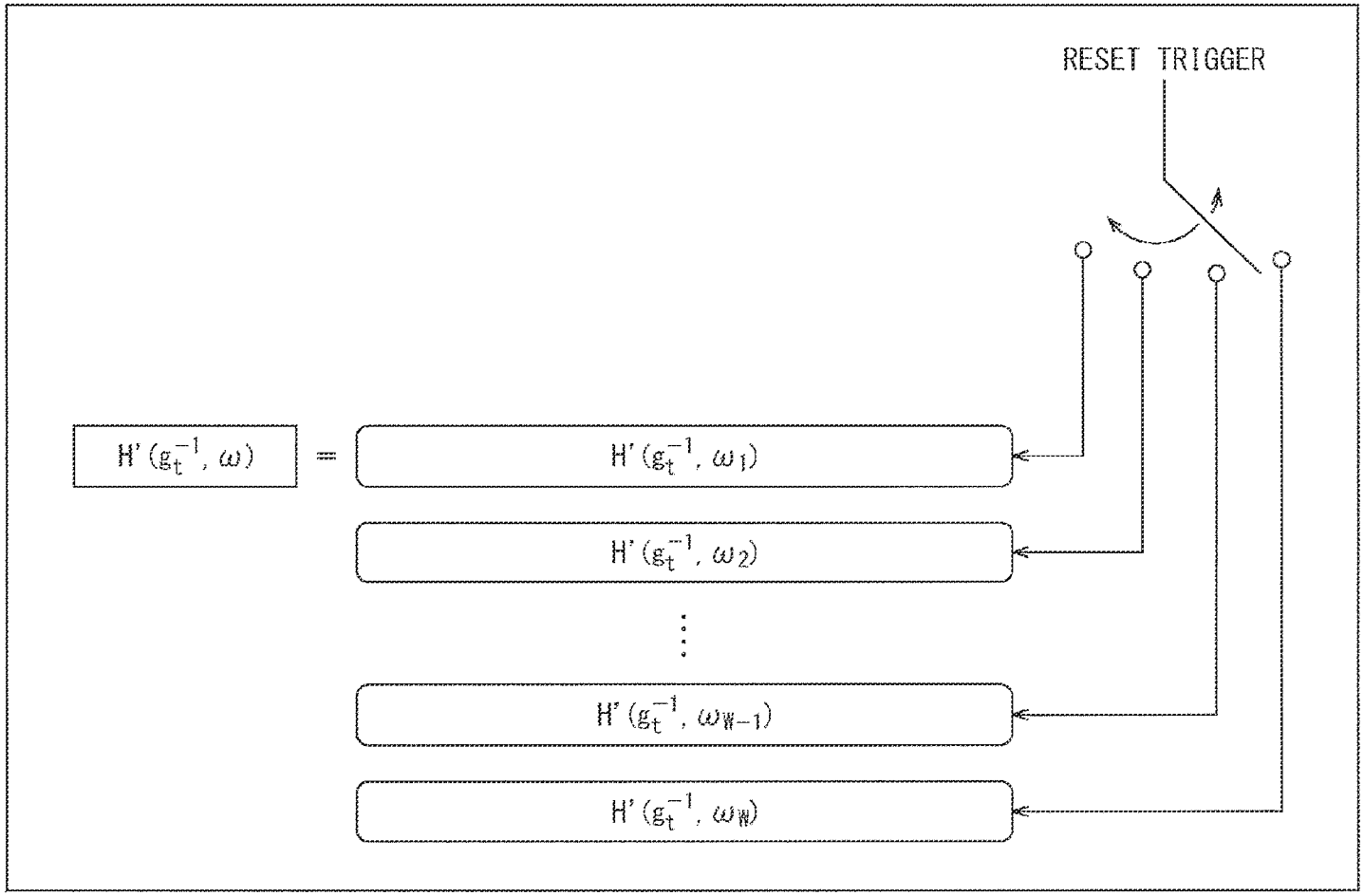
FIG. 19 is a diagram describing resetting for each time frequency.

For example, as illustrated in FIG. 19, it is assumed that the number of time frequency bins ω is W, and the row vector $H'(g_t^{-1}, \omega)$ is determined for W number of time frequencies $\omega_1$ to $\omega_W$. That is, row vectors $H'(g_t^{-1}, \omega_1)$ to $H'(g_t^{-1}, \omega_W)$ are obtained.

In such a case, for example, resetting may be performed only for a predetermined time frequency ω. At this time, the resetting may be performed at different timings for the respective time frequencies ω, or the resetting may be performed simultaneously for some time frequencies ω.

For example, in the audio processor 11 illustrated in FIG. 14, at a timing at which the resetting is performed only for the time frequency $\omega_1$, the processes in the steps S58 and S59 in FIG. 15 are performed for the time frequency $\omega_1$ to generate the row vector $H'(g_t^{-1}, \omega_1)$.

In contrast, for the time frequencies $\omega_2$ to t $\omega_W$, the processes in the steps S53 to S57 in FIG. 15 are performed to generate the row vectors $H'(g_t^{-1}, \omega_2)$ to $H'(g_t^{-1}, \omega_W)$.

It is to be noted that, even in a case where the resetting is performed for each time frequency ω, some groups such as a group including one or a plurality of time frequencies w may be provided, and the resetting may be performed for each of the groups.

Modification Example 4 of Second Embodiment

<Another Example of Control System>

Further, in the control system illustrated in FIG. 16, it is assumed that the audio processors 71 corresponding to a plurality of listeners are operated by one computing system located in the middle.

However, it is difficult to previously determine performance of the computing system in the middle in a case where the number of listeners changes dynamically.

Accordingly, in a case where a system (slave) for each listener, such as a smartphone, may independently perform processing of generating a drive signal for each listener, and the slave does not have sufficient processing performance to perform the resetting described above, a device (master) in the middle to which the slave is coupled may perform a portion or the entirety of an operation at the time of the resetting.

Figure 20:
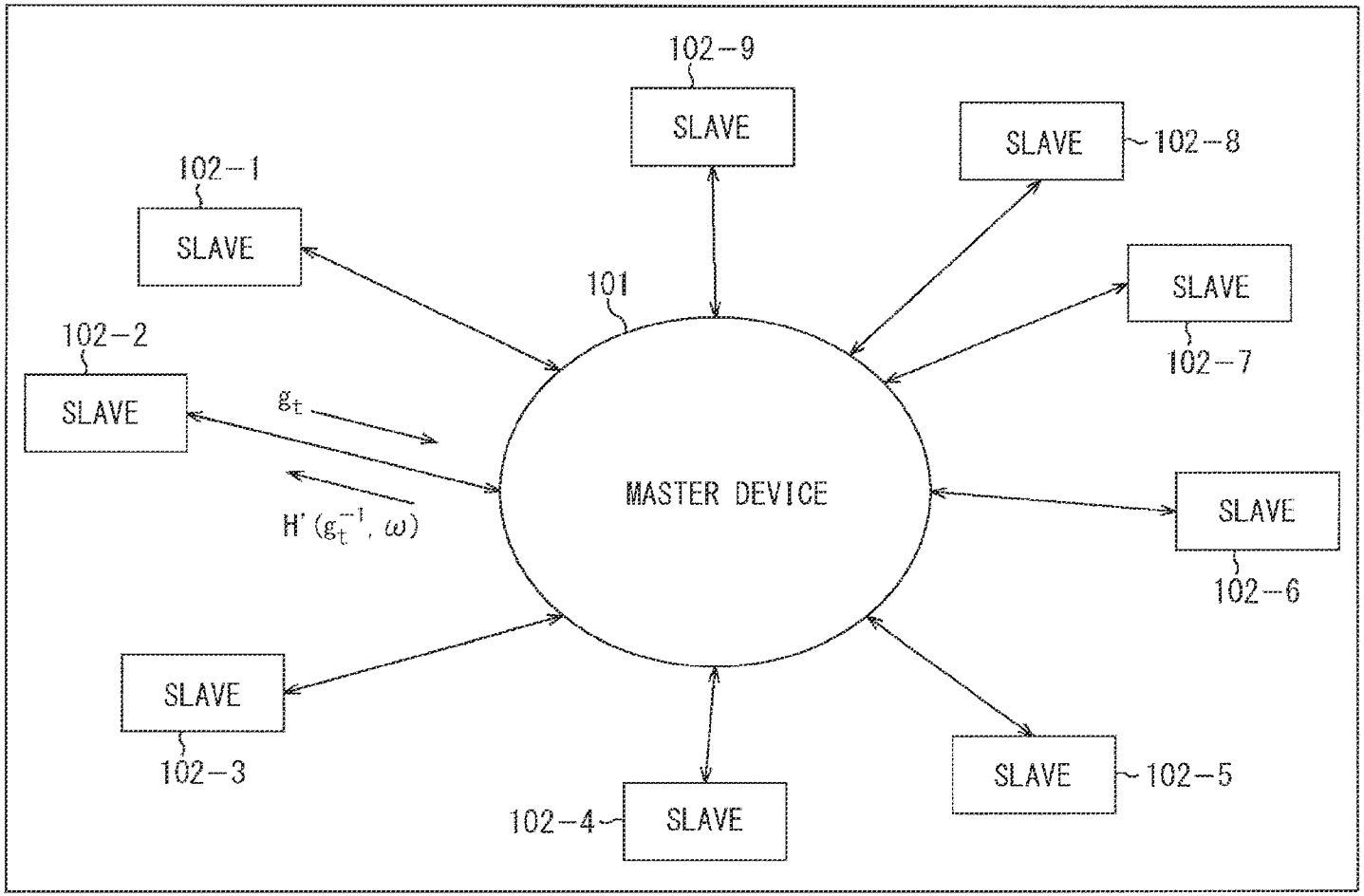
FIG. 20 is a diagram illustrating a configuration example of a control system.

In such a case, the control system is configured, for example, as illustrated in FIG. 20.

The control system illustrated in FIG. 20 includes a master device 101 and slave 102-1 to slave 102-9.

In this example, the master device 101 and each of the slaves 102-1 to 102-9 are coupled to each other through a wired or wireless network. It is to be noted that, hereinafter, in a case where it is not necessary to particularly distinguish the slaves 102-1 to 102-9, the slaves 102-1 to 102-9 are also simply referred to as slaves 102.

Instead of the slaves 102, the master device 101 performs a portion of an operation (processing) originally performed in the slaves 102, and supplies a result of the operation result to the slaves 102.

The slaves 102 each include, for example, headphones, a smartphone, or the like, and correspond to the audio processor 11 illustrated in FIG. 14. The slaves 102 each perform the drive signal generation processing described with reference to FIG. 15 in accordance with rotation of the head of the listener, and outputs the drive signal, but requests the master device 101 to perform a portion of an operation of the drive signal generation processing, such as an operation at the time of the resetting.

In a specific example, it is possible for the master device 101 to perform the operation at the time of the resetting, for example.

In this case, the slave 102 transmits, to the master device 101, an operation request for calculation of the row vector $H'(g_t^{-1}, \omega)$ together with the angle $g_t$ or the rotation matrix $R'(g_t)$.

Then, the master device 101 that has received the operation request from the slave 102 and the angle $g_t$ or the rotation matrix $R'(g_t)$ performs an operation of the following expression (42) in response to the operation request, and transmits the resultant row vector $H'(g_t^{-1}, \omega)$ to the slave 102.

[Math. 42]

$$H'(g_t^{-1},\omega)=H_s(\omega)R'(g_t) \tag{42}$$

It is to be noted that the row vector $H_s(\omega)$ to be used in the operation of the expression (42) may be obtained from the slave 102 by the master device 101 in advance, or may be held in the master device 101 in advance.

In such a manner, it is possible for the slave 102 to obtain a drive signal of sound to be presented to the listener with a small operation amount with use of the row vector $H'(g_t^{-1}, \omega)$ received from the master device 101.

It is to be noted that, as described above, the resetting may be performed for each listener, each degree n, each order m, each time frequency ω, or the like, and appropriately determining the timing of the resetting makes it possible to reduce the operation load on the master device 101. For example, performing the resetting for the respective slaves 102 at different timings makes it possible to reduce the operation load on the master device 101.

Modification Example 5 of Second Embodiment

<Another Example of Control System>

Contrary to the case of the modification example 4 of the second embodiment, the slave 102 may perform the operation at the time of the resetting.

In such a case, the master device 101 sequentially receives the angle $g_t$, the rotation matrix $R'(\Delta g_t)$, or the like from the slave 102, performs an operation expressed by the following expression (43), and calculates the row vector $H'(g_t^{-1}, \omega)$.

[Math. 43]

$$H_n'^m(g_t^{-1}, \omega) = \sum_{k=max(-n,m-C)}^{min(n,m+C)} H_n'^k(g_{t-1}^{-1}, \omega)R_{k,m}'^{(n)}(\Delta g_t) \tag{43}$$

It is to be noted that the master device 101 may perform operations up to the calculation of the row vector $H'(g_t^{-1}, \omega)$ and the slave 201 may perform the remaining operations up to obtaining of the drive signal, or the master device 101 may calculate the drive signal with use of the row vector $H'(g_t^{-1}, \omega)$ and supply the drive signal to the slave 102.

In addition, at the time of the resetting, the slave 102 performs the operation of the expression (42) described above, and the resultant row vector $H'(g_t^{-1}, \omega)$ is transmitted from the slave 102 to the master device 101. This makes it possible for the master device 101 to hold the row vector $H'(g_t^{-1}, \omega)$ received from the slave 102 and use the row vector $H'(g_t^{-1}, \omega)$ for the operation of the expression (43) to be performed next time.

The slave 102 performs the operation at the time of the resetting in such a manner, which makes it possible for the master device 101 to update the row vector $H'(g_t^{-1}, \omega)$ that is normally calculated on the basis of a difference to the more accurate row vector $H'(g_t^{-1}, \omega)$, and reset an error.

It is to be noted that the row vector $H_s(\omega)$ necessary for the operation at the time of the resetting may be obtained from the master device 101 by the slave 102 in advance, may be held in the slave 102 in advance, or may be held in both the master device 101 and the slave 102 in advance.

In addition, in a case where only one device of the master device 101 and the slave 102 holds the row vector $H_s(\omega)$ or the like, the row vector $H_s(\omega)$ or the like held by the one device may be transmitted to the other device at an optional timing such as the time of coupling or the time of initialization.

Further, even in this embodiment, the resetting may be performed for each listener, each degree n, each order m, each time frequency ω, or the like, and it is possible to appropriately determine the timing of the resetting. However, in a case where the operation at the time of the resetting is performed by the slave 102, the operation at the time of the resetting for a plurality of listeners is not performed simultaneously in one slave 102; therefore, it is not necessary to disperse the timing of the resetting.

In addition, the master device 101 and the slave 102 may share the drive signal generation processing described with reference to FIG. 13 and FIG. 15. That is, the master device 101 has some of functions to perform the drive signal generation processing, which makes it possible to flexibly cope with a case where the number of listeners increases dynamically, and the like.

<Configuration Example of Computer>

Incidentally, it is possible to execute the series of processing described above by hardware or software. In a case where the series of processing is executed by the software, a program including that software is installed in a computer. Herein, the computer includes a computer incorporated into dedicated hardware and, for example, a general-purpose computer capable of executing various functions by being installed with various programs.

Figure 21:
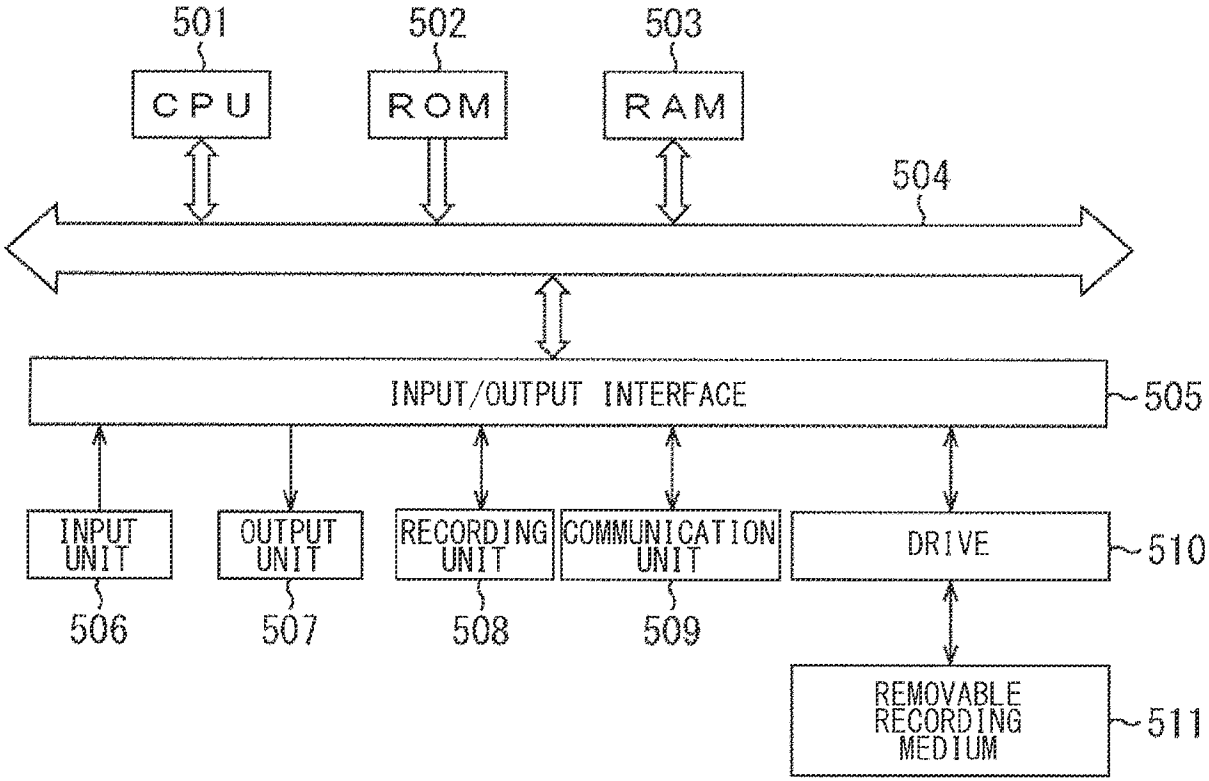
FIG. 21 is a diagram illustrating a configuration example of a computer.

FIG. 21 is a block diagram illustrating a configuration example of the hardware of the computer that executes the series of processing described above by a program.

In the computer, a CPU (Central Processing Unit) 501, a ROM (Read Only Memory) 502, and a RAM (Random Access Memory) 503 are coupled to each other by a bus 504.

A input/output interface 505 is further coupled to the bus 504. An input unit 506, an output unit 507, a recording unit 508, a communication unit 509, and a drive 510 are coupled to the input/output interface 505.

The input unit 506 includes a keyboard, a mouse, a microphone, an imaging element, and the like. The output unit 507 includes a display, a speaker, and the like. The recording unit 508 includes a hard disk, a nonvolatile memory, and the like. The communication unit 509 includes a network interface and the like. The drive 510 drives a removable recording medium 511 such as a magnetic disk, an optical disk, a magneto-optical disk, or a semiconductor memory.

In the computer configured as described above, the CPU 501 loads, for example, a program recorded on the recording unit 508 into the RAM 503 through the input/output interface 505 and the bus 504, and executes the program, thereby performing the series of processing described above.

It is possible to record the program to be executed by the computer (the CPU 501), for example, in the removable recording medium 511 as a package medium or the like and provide the program. Moreover, it is possible to provide the program through a wired or wireless transmission medium such as a local area network, the Internet, digital satellite broadcasting, or the like.

In the computer, it is possible to install the program in the recording unit 508 through the input/output interface 505 by mounting the removable recording medium 511 to the drive 510. Further, it is possible to receive the program by the communication unit 509 through the wired or wireless transmission medium and install the program on the recording unit 508. In addition, it is possible to install the program on the ROM 502 or the recording unit 508 in advance.

It is to be noted that the program to be executed by the computer may be a program in which processing is performed in time series in sequence described in this specification, or may be a program in which processing are performed in parallel or at a necessary timing such as when a timing at which calling is performed.

Moreover, embodiments of the present technology are not limited to the foregoing embodiments, and may be modified in variety of ways in a scope without departing from the gist of the present technology.

For example, it is possible for the present technology to adopt a configuration of cloud computing in which one function is shared and collaboratively processed by a plurality of devices through a network.

It is possible to execute each of the steps described in the flow charts described above by one device or to share and execute each of the steps by a plurality of devices.

Further, in a case where a plurality of processes is included in one step, it is possible to execute the plurality of processes included in that one step by one device or to share and execute the plurality of processes by a plurality of devices.

In addition, effects described in this specification are merely illustrative and non-limiting, and other effects may be included.

Further, the present technology may have the following configurations.

(1)

A signal processing device including:

a rotation operation unit that rotates a head-related transfer function in a spherical harmonic domain by an operation on the basis of a rotation matrix corresponding to rotation of a head of a listener, the operation in which an order of the rotation matrix is limited; and a synthesis unit that synthesizes the head-related transfer function after rotation obtained by the operation and a sound signal of the spherical harmonic domain to generate a headphone drive signal.

(2)

The signal processing device according to (1), in which, for a rotation operation of the head-related transfer function in at least one rotation direction, the rotation operation unit performs the rotation operation at a predetermined time with use of an operation result of the rotation operation in the rotation direction at another time before the predetermined time to determine the head-related transfer function after the rotation at the predetermined time.

(3)

The signal processing device according to (2), in which the rotation operation unit performs the rotation operation in the rotation direction at the predetermined time on the basis of a rotation matrix corresponding to a difference between a rotation angle in the rotation direction of the head of the listener at the predetermined time and a rotation angle in the rotation direction of the head of the listener at the other time, and the operation result of the rotation operation in the rotation direction at the other time.

(4)

The signal processing device according to (3), in which the rotation operation unit performs the rotation operation only on an element having the order within a predetermined range as the operation in which the order is limited.

(5)

The signal processing device according to (3) or (4), in which, for an elevation angle direction as the rotation direction, the rotation operation unit performs the rotation operation in the rotation direction at the predetermined time with use of the operation result of the rotation operation in the rotation direction at the other time.

(6)

The signal processing device according to any one of (3) to (5), in which in a case where resetting of the rotation matrix is not performed, the rotation operation unit performs the rotation operation in the rotation direction at the predetermined time with use of the operation result of the rotation operation in the rotation direction at the other time, and in a case where the resetting of the rotation matrix is performed, the rotation operation unit performs the rotation operation in the rotation direction at the predetermined time on the basis of a rotation matrix corresponding to a rotation angle in the rotation direction of the head of the listener at the predetermined time and the head-related transfer function.

(7)

The signal processing device according to (6), in which the resetting is performed for each degree, each order, or each time frequency.

(8)

The signal processing device according to (6) or (7), in which, in a case where the headphone drive signal is generated for each of a plurality of the listeners, the resetting is performed for each of the listeners.

(9)

The signal processing device according to any one of (6) to (8), in which, in a case where the resetting is performed, the rotation operation unit performs the rotation operation with use of a rotation matrix determined in advance as the rotation matrix corresponding to the rotation angle in the rotation direction of the head of the listener at the predetermined time.

(10)

The signal processing device according to any one of (1) to (9), in which, in a case where a rotation matrix, which is included in the rotation matrix corresponding to the rotation of the head, for performing rotation to a predetermined rotation direction is represented by a sum of a plurality of matrices, the rotation operation unit performs, as the operation in which the order is limited, an operation of rotating the head-related transfer function with use of a sum of some of the plurality of the matrices as the rotation matrix for performing the rotation to the predetermined rotation direction.

(11)

A signal processing method including steps of:

rotating a head-related transfer function in a spherical harmonic domain by an operation on the basis of a rotation matrix corresponding to rotation of a head of a listener, the operation in which an order of the rotation matrix is limited; and synthesizing the head-related transfer function after rotation obtained by the operation and a sound signal of the spherical harmonic domain to generate a headphone drive signal.

(12)

A program causing a computer to execute processing, the processing including steps of:

rotating a head-related transfer function in a spherical harmonic domain by an operation on the basis of a rotation matrix corresponding to rotation of a head of a listener, the operation in which an order of the rotation matrix is limited; and synthesizing the head-related transfer function after rotation obtained by the operation and a sound signal of the spherical harmonic domain to generate a headphone drive signal.

REFERENCE SIGNS LIST

11: audio processor
21: head rotation sensor unit
22: previous direction holding unit
23: rotation matrix operation unit
24: rotation operation unit
25: rotation coefficient holding unit
26: head-related transfer function holding unit
27: head-related transfer function synthesis unit
28: time frequency inverse transformation unit

The invention claimed is:

1. A signal processing device, comprising:

a rotation operation unit configured to:

rotate a head-related transfer function in a spherical harmonic domain based on a rotation operation, wherein the rotation operation is based on rotation matrix corresponding to rotation of a head of a listener, and an order of the rotation matrix in the rotation operation is less than a threshold; and execute the rotation operation of the head-related transfer function in at least one rotation direction at a first time based on an operation result of the rotation operation in the at least one rotation direction at a second time and a rotation matrix, wherein the second time is before the first time, the rotation operation is executed to determine the head-related transfer function after the rotation at the first time, and the rotation matrix corresponds to a difference between a rotation angle in the at least one rotation direction of the head of the listener at the first time and a rotation angle in the at least one rotation direction of the head of the listener at the second time; and a synthesis unit configured to:

synthesize the head-related transfer function after the rotation, and synthesize a sound signal of the spherical harmonic domain to generate a headphone drive signal.

2. The signal processing device according to claim 1, wherein the rotation operation unit is further configured to execute the rotation operation only on an element having an order within a specific range as the rotation operation in which the order is less than the threshold.

3. The signal processing device according to claim 1, wherein, for an elevation angle direction as the at least one rotation direction, the rotation operation unit is further configured to execute the rotation operation in the at least one rotation direction at the first time with use of the operation result of the rotation operation in the at least one rotation direction at the second time.

4. The signal processing device according to claim 1, wherein when resetting of the rotation matrix is not executed, the rotation operation unit is further configured to execute the rotation operation in the at least one rotation direction at the first time with use of the operation result of the rotation operation in the at least one rotation direction at the second time, and when the resetting of the rotation matrix is executed, the rotation operation unit is further configured to execute the rotation operation in the at least one rotation direction at the first time based on rotation matrix corresponding to a rotation angle in the at least one rotation direction of the head of the listener at the first time and the head-related transfer function.

5. The signal processing device according to claim 4, wherein the resetting is executed for each degree, each order, or each time frequency.

6. The signal processing device according to claim 4, wherein, based on generation of the headphone drive signal for each of a plurality of listeners, the resetting is executed for each of the plurality of listeners.

7. The signal processing device according to claim 4, wherein, based on the execution of the resetting of the rotation matrix, the rotation operation unit is further configured to execute the rotation operation with use of a rotation matrix determined in advance as the rotation matrix corresponding to the rotation angle in the at least one rotation direction of the head of the listener at the first time.

8. The signal processing device according to claim 1, wherein, based on representation of a rotation matrix, which is included in the rotation matrix corresponding to the rotation of the head, for execution of rotation to a specific rotation direction by a sum of a plurality of matrices, the rotation operation unit is further configured to execute, as the rotation operation in which the order is less than the threshold, an operation of rotating the head-related transfer function with use of a sum of some of the plurality of the matrices as the rotation matrix for execution of the rotation to the specific rotation direction.

9. A signal processing method, comprising:

rotating a head-related transfer function in a spherical harmonic domain based on a rotation operation, wherein the rotation operation is based on a rotation matrix corresponding to rotation of a head of a listener, and an order of the rotation matrix in the rotation operation is less than a threshold;

executing the rotation operation of the head-related transfer function in at least one rotation direction at a first time based on an operation result of the rotation operation in the at least one rotation direction at a second time and a rotation matrix, wherein the second time is before the first time, the rotation operation is executed to determine the head-related transfer function after the rotation at the first time, and the rotation matrix corresponds to a difference between a rotation angle in the at least one rotation direction of the head of the listener at the first time and a rotation angle in the at least one rotation direction of the head of the listener at the second time;

synthesizing the head-related transfer function after the rotation; and synthesizing a sound signal of the spherical harmonic domain to generate a headphone drive signal.

10. A non-transitory computer-readable medium having stored thereon computer-executable instructions, that when executed by a processor, cause the processor to execute operations, the operations comprising:

rotating a head-related transfer function in a spherical harmonic domain based on a rotation operation, wherein the rotation operation is based on a rotation matrix corresponding to rotation of a head of a listener, and an order of the rotation matrix in the rotation operation is less than a threshold;

executing the rotation operation of the head-related transfer function in at least one rotation direction at a first time based on an operation result of the rotation operation in the at least one rotation direction at a second time and a rotation matrix, wherein the second time is before the first time, the rotation operation is executed to determine the head-related transfer function after the rotation at the first time, and the rotation matrix corresponds to a difference between a rotation angle in the at least one rotation direction of the head of the listener at the first time and a rotation angle in the at least one rotation direction of the head of the listener at the second time;

synthesizing the head-related transfer function after the rotation; and synthesizing a sound signal of the spherical harmonic domain to generate a headphone drive signal.

* * * * *